US007445474B2

(12) United States Patent
Sakatani et al.

(10) Patent No.: US 7,445,474 B2
(45) Date of Patent: Nov. 4, 2008

(54) LEVER-TYPE CONNECTOR AND LEVER-TYPE CONNECTOR ASSEMBLY

(75) Inventors: Atsushi Sakatani, Yokkaichi (JP); Yoshihiro Uchiyama, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/268,289

(22) Filed: Nov. 4, 2005

(65) Prior Publication Data

US 2006/0096848 A1 May 11, 2006

(30) Foreign Application Priority Data

Nov. 5, 2004 (JP) ..... 2004-322656
Aug. 30, 2005 (JP) ..... 2005-249325

(51) Int. Cl.
*H01R 13/66* (2006.01)

(52) U.S. Cl. ..... 439/157; 439/158

(58) Field of Classification Search ..... 439/157, 439/158, 159
See application file for complete search history.

(56) References Cited

U.S. PATENT DOCUMENTS 5,230,635 A * 7/1993 Takenouchi et al. ..... 439/157
5,611,703 A 3/1997 Okamoto et al.
6,164,991 A * 12/2000 Matsuura et al. ..... 439/157
6,312,273 B1 * 11/2001 Hasegawa et al. ..... 439/157
6,666,697 B2 * 12/2003 Yamashita ..... 439/157
6,755,674 B2 * 6/2004 Fujii et al. ..... 439/157
6,764,324 B2 * 7/2004 Shinozaki et al. ..... 439/157
6,905,355 B2 * 6/2005 Fukamachi ..... 439/157
6,942,504 B2 * 9/2005 Shinozaki et al. ..... 439/157
7,063,547 B2 * 6/2006 Toyoda et al. ..... 439/157
7,063,548 B2 * 6/2006 Ohara ..... 439/157

* cited by examiner

*Primary Examiner*—Tulsidas C. Patel
*Assistant Examiner*—Harshad C Patel
(74) *Attorney, Agent, or Firm*—Gerald E. Hespos; Anthony J. Casella

(57) ABSTRACT

A lever (30) can be assembled in either of two postures symmetrical with respect to an axis of symmetry (19), and the rotating direction of the lever (30) changes depending on the assembling posture. Thus, the rotating direction of the lever (30) can be selected depending on circumstances. A cam follower (52) can enter a cam groove (33) regardless of the posture in which the lever (30) is assembled. The lever (30) can be held at a standby position by a holder (21L, 21R, 22, 34, 36), and the lever (30) can be locked at a connection position by a lock (21L, 21R, 23L, 23R, 39, 41).

18 Claims, 30 Drawing Sheets

LEVER-TYPE CONNECTOR AND LEVER-TYPE CONNECTOR ASSEMBLY

BACKGROUND OF THE INVENTION

1. Field of the Invention

The invention relates to a lever-type connector.

2. Description of the Related Art

U.S. Pat. No. 5,611,703 discloses a connector with a lever that is assembled rotatably with a first housing. The lever has a cam groove that receives a cam follower of a second housing when the lever is at a standby position. The lever then is displaced to a connection position. As a result, the cam groove engages the cam follower and develops a force multiplying action that connects the two housings.

The lever has an operable portion and two plate-shaped arms that extend from the opposite ends of an operable portion. The arms are present at the opposite sides of the first housing, and hence enlarge the connector. The lever is assembled with the first housing in only one mode, and the operating direction of the lever is restricted. Thus, the operability of the lever may be deteriorated if the connector is arranged in a narrow space.

The invention was developed in view of these problems and an object thereof is to provide a small efficient connector.

SUMMARY OF THE INVENTION

The invention relates to a lever-type connector with a first housing that is connectable with a second housing. A lever is assembled displaceably with the first housing and has at least one cam that can display a cam action in cooperation with at least one mating cam. The lever can be moved from a standby position to a connection position to develop a cam action between the cam and the mating cam for connecting the first and second housings. Holding means are provided at the first housing and the lever for holding the lever at the standby position. Locking means are provided at the first housing and/or the lever for locking the lever at the connection position. The lever preferably is a single plate and can be assembled with the first housing in two postures substantially symmetrical with respect to an axis of symmetry parallel to a connecting direction of the first housing with the second housing. The holding means of the first housing is arranged at a position substantially on the axis of symmetry or arranged at two positions substantially symmetrical with respect to the axis of symmetry. The locking means of the first housing is substantially on the axis of symmetry or is at two positions substantially symmetrical with respect to the axis of symmetry.

The lever can be assembled with the first housing in either of the two postures substantially symmetrical with respect to the axis of symmetry, and the displacement direction of the lever changes depending on the assembling posture. Accordingly, the displacement operability of the lever can be improved by selecting the assembling posture of the lever depending on circumstances in which the connector is arranged. Further, the plate-shaped lever is smaller than a lever that has an operable portion and arms at opposite ends of the operable portion. The holding means can hold the lever at the standby position regardless of the posture in which the lever is assembled, and the lever can be locked at the connection position by the locking means.

The cam means preferably comprises a cam groove and the entrance of the cam groove preferably is on the axis of symmetry when the lever is at the standby position.

The lever preferably is displaced by rotating or pivoting the lever around an axis through which the axis of symmetry passes.

The lever preferably has an operable portion for displacing the lever. The operable portion preferably includes a plate-shaped resilient lock that is resiliently displaceable between a locking position where the resilient lock engages the locking means of the first housing and an unlocking position where the resilient lock disengages from the locking means of the first housing.

The resiliently displacing directions of the resilient lock preferably are substantially the same as the thickness direction of the lever.

The plate-shaped resilient lock preferably has a wide finger-placing area to accommodate placement of an operator's fingers. The finger-placing area preferably has a surface substantially parallel with or in flush with the plate surface of the lever. Accordingly, the lever is not enlarged in the thickness direction even if the resilient lock is widened.

The first housing preferably has an accommodation space for at least partly accommodating the lever.

A protecting portion preferably surrounds at least part of the resilient lock. An area of the operable portion including the protecting portion preferably is displaced outside the accommodation space in the process of displacing the lever.

A dead space would be formed in the accommodation space and would unnecessarily enlarge the first housing If the accommodation space was enlarged to permit the protecting portion to be displaced in the accommodation space. However, the protecting portion is displaced outside the accommodation space in the present invention. Thus, the accommodation space can be smaller and the first housing can be miniaturized.

The lever preferably is supported detachably on the first housing in either of the two postures and can be detached by being displaced away from the first housing after moving from the connection position to a detachment position. Accordingly, the connector can be miniaturized, and the lever can be detached conveniently with significant labor and time savings. Furthermore, it is not necessary to provide the lever for each connector by using the lever as a jig for connectors and hence the number of parts can be reduced.

The detachment position preferably is beyond the connection position.

Detaching means preferably are provided between the first housing and the lever for displacing the lever away from the first housing and to disengage a supported portion. The detaching means preferably engage with each other when the lever reaches the detachment position.

These and other features and advantages of the invention will be more apparent upon reading the following description of preferred embodiments and accompanying drawings. Even though embodiments are described separately, single features may be combined.

DETAILED DESCRIPTION OF THE PREFERRED EMBODIMENTS

Figure 1:
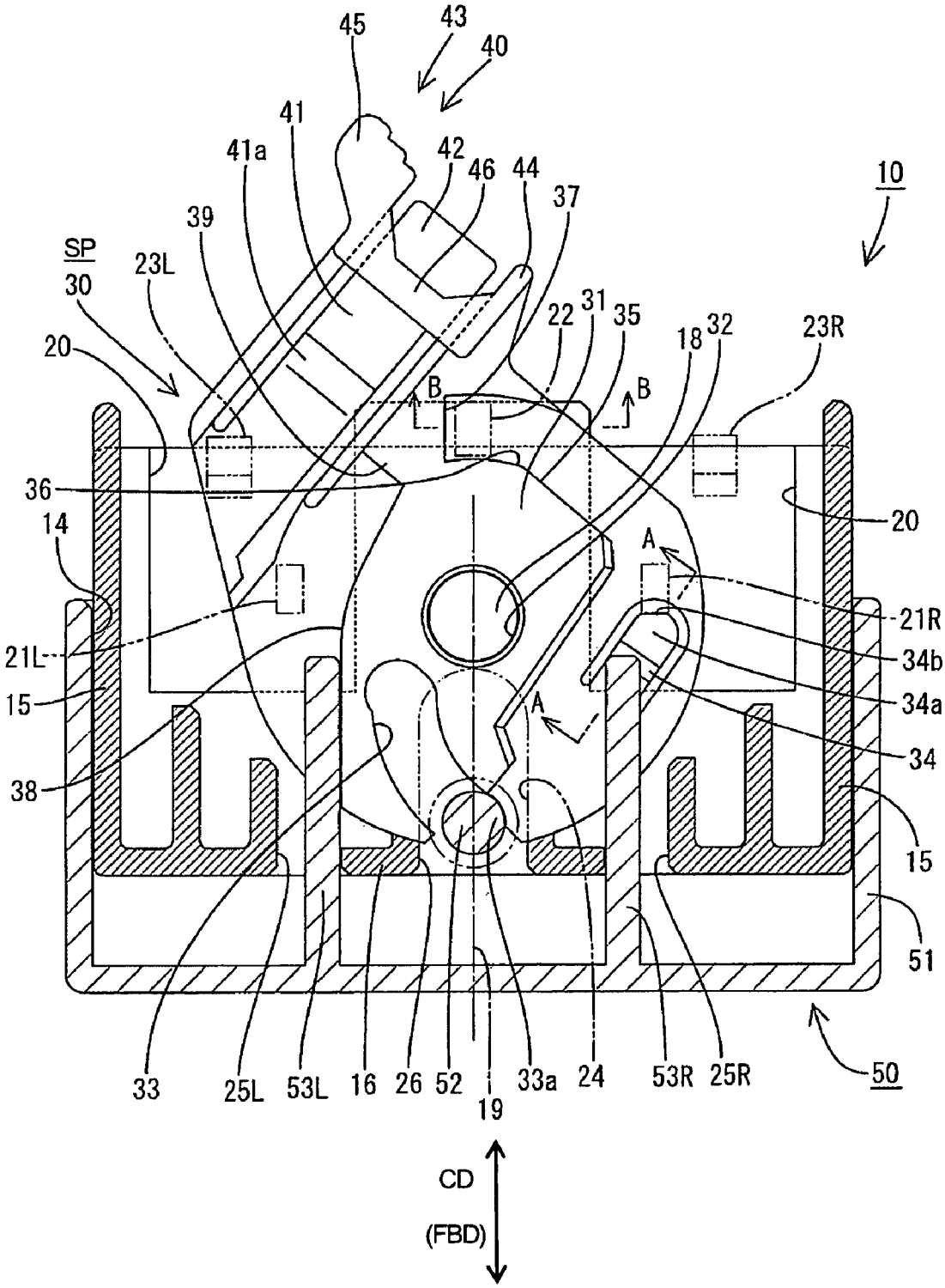
FIG. 1 is a horizontal section showing an initially fitted state of a second housing with a lever held at a standby position in a first embodiment.

A first embodiment of the present invention is described herein with reference to FIGS. 1 to 16. A connector according to this embodiment has a first housing 10 and a second housing 20 that are connected with and separated from each other using a movable member a lever 30. In the following, sides of the housings 10, 20 to be connected with each other are referred to as front.

The first housing 10 is made e.g. of a synthetic resin and is substantially in the form of a rectangular block. The first housing 10 includes a wide substantially block-shaped terminal accommodating portion 11 and cavities 12 penetrate the terminal accommodating portion 11 in forward and backward directions FBD. A terminal fitting (not shown) is inserted into each cavity 12 from behind and is locked by a lock 13 formed in the cavity 12. A wire (not shown) is connected with the rear end of the terminal fitting and is drawn out backward from the first housing 10.

A rearwardly open accommodation space 14 is provided on upper surface of the terminal accommodating portion 11 and is configured for accommodating the lever 30. The lever 30 preferably has a height that is less than dimensions of the lever 30 along forward and backward directions FBD and transverse directions TD. Thus, the accommodation space 14 is a flat rectangular space with a short height. The accommodation space 14 is enclosed partly by two side walls 15, a front wall 16 and an upper wall 17. The side walls 15 project up from opposite left and right edges of the terminal accommodating portion 11, and the front wall 16 projects up from the front surface of the terminal accommodating portion 11. The upper wall 17 couples the upper ends of the left and right walls 15 and is substantially continuous with the upper end of the front wall 16.

A substantially round supporting shaft 18 projects up from the bottom surface of the accommodation space 14 and has a center axis that extends substantially along the vertical direction VD and substantially normal to a connecting direction CD of the two housings 10, 50. An axis of symmetry 19 extends substantially parallel with the connecting direction CD of the two housings 10, 50 and defines a phantom straight line passing the center axis of the supporting shaft 18. Left and right substantially rectangular deformation spaces 20 are formed by lightly recessing the bottom surface of the accommodation space 14. The deformation spaces 20 preferably are transversely symmetrical with respect to the axis of symmetry 19 and extend up to the open rear end of the accommodation space 14.

Holding means are provided at the lower surface of the upper wall 17 facing the accommodation space 14 and function to hold the lever 30 at a standby position SP. The holding means comprise a front-stop holding means for preventing a rotation of the lever 30 towards a connection position CP, and a reverse-rotation holding means for preventing the lever 30 from rotating in a direction opposite to the connection position CP. The front-stop holding means includes front-stops 21L, 21R that project down at two transversely spaced positions that are substantially transversely symmetrical with respect to the axis of symmetry 19. The front-stop portions 21L, 21R are at substantially middle positions with respect to forward and backward directions FBD. The reverse-rotation holding means includes a reverse-rotation preventing portion 22 that projects down and in substantially on the axis of symmetry 19, and is arranged at the rear opening edge of the accommodation space 14.

Similarly, locking means for locking the lever 30 at the connection position CP is provided at the lower surface of the upper wall 17 facing the accommodation space 14. The locking means comprises front-stop locking means for preventing the lever 30 from being rotated towards a side opposite to the standby position SP, and return-preventing locking means for preventing the lever 30 from being rotated towards the standby position SP. The front-stop locking means also comprises the left and right front-stops 21L, 21R as the front-stop holding means. The return-preventing locking means includes return preventing portions 23L, 23R that project down and in at two transversely spaced positions that are substantially transversely symmetrical with respect to the axis of symmetry 19. The return preventing portions 23L, 23R are arranged at the rear opening edge of the accommodation space 14. The return preventing portions 23L, 23R are more distanced from the axis of symmetry 19 than the front-stop portions 21L, 21R.

A first escaping groove 24 extends back from a widthwise center of the front edge of the upper wall 17 of the accommodation space 14. The transverse center of the first escaping groove 24 substantially coincides with the axis of symmetry 19. Two long narrow second escaping grooves 25L, 25R extend back from the front edge of the upper wall 17 at two positions spaced apart along the width direction and substantially transversely symmetrical with respect to both the axis of symmetry 19 and the center axis of the first escaping groove 24. The second escaping grooves 25L, 25R are arranged along the inner sides of the front-stops 21L, 21R. Both the first escaping groove 24 and the second escaping grooves 25L, 25R penetrate the upper wall 17 from the upper surface to the lower surface and extend substantially linearly substantially parallel with the connecting direction CD of the two housings 10, 50. A substantially rectangular insertion opening 26 penetrates the front wall 16 and communicates with the first escaping groove 24.

Figure 2:
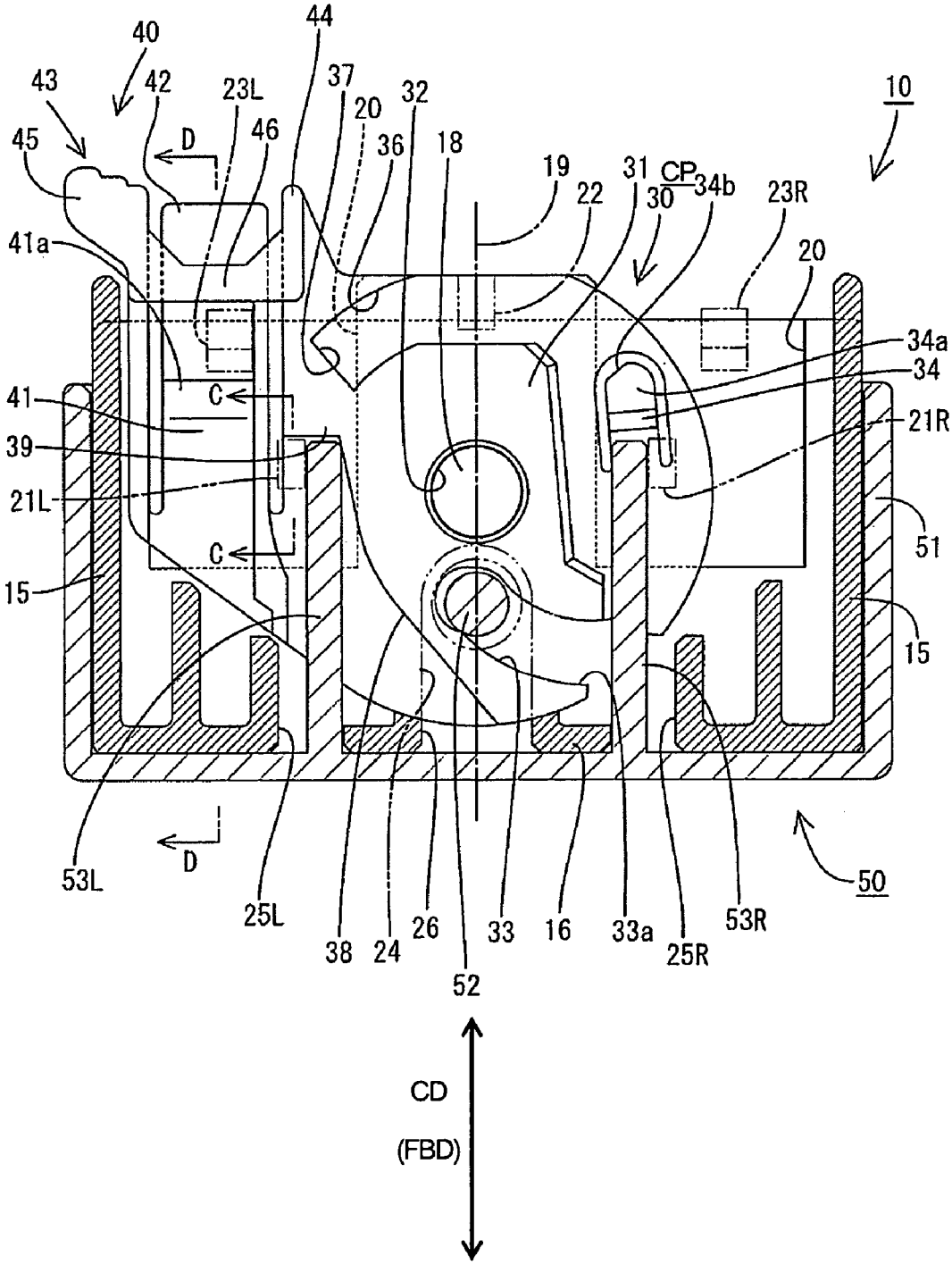
FIG. 2 is a horizontal section showing a connected state of two housings reached by rotating the lever to a connection position.
Figure 3A:
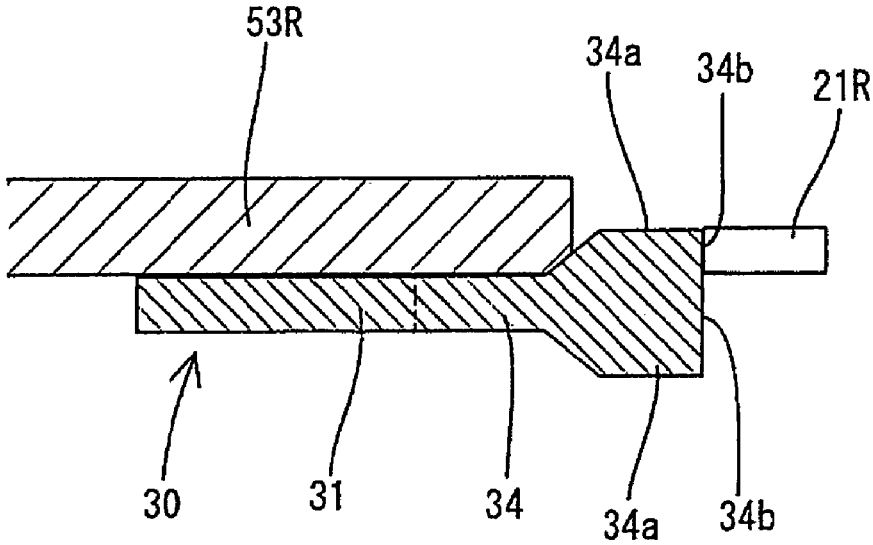
FIGS. 3(*a*) and 3(*b*) are a section along 3-3 showing a state where a resilient locking piece is in contact with a front-stop portion, and a section along 3-3 showing a state where the locked state of the front-stop portion by the resiliently locking piece is canceled by a freeing portion.
Figure 3B:
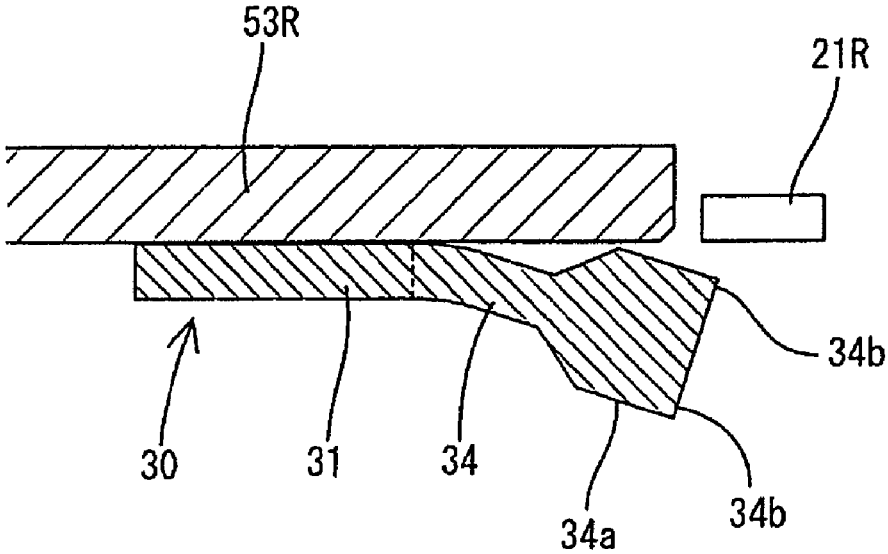
Figure 4:
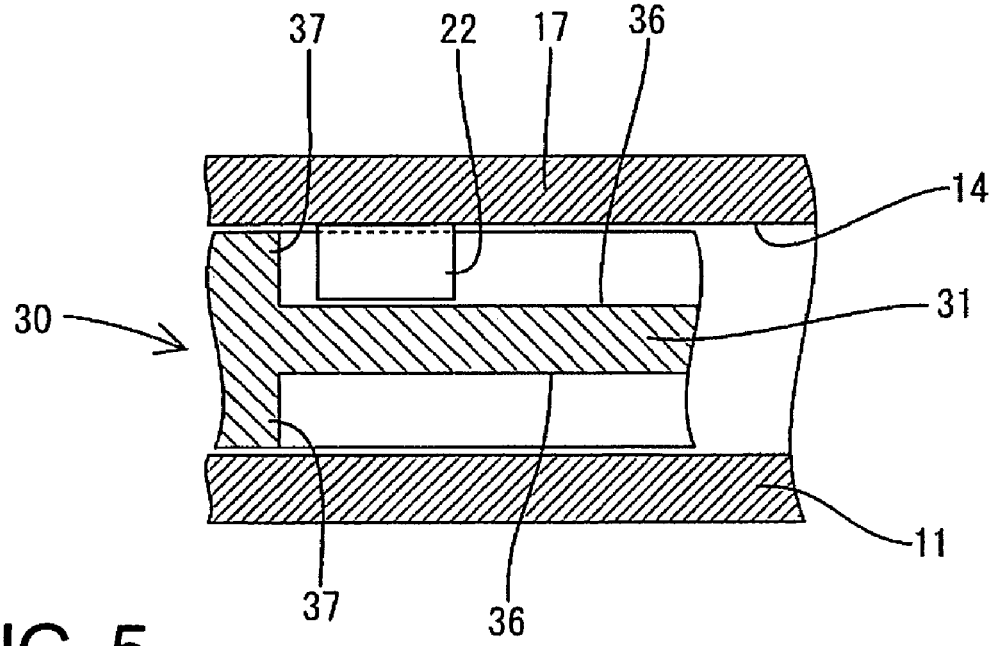
FIG. 4 is a section along 4-4 of FIG. 1.
Figure 5:
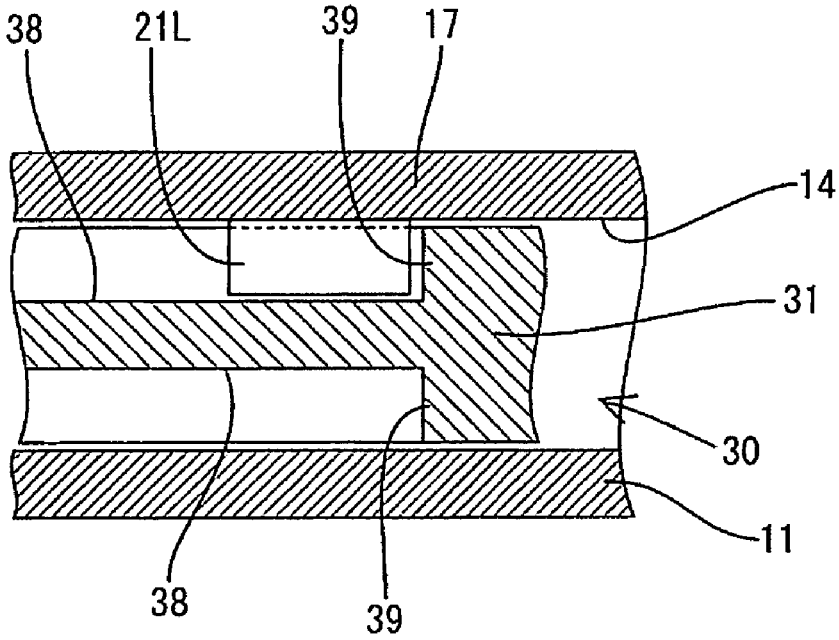
FIG. 5 is a section along 5-5 of FIG. 2.
Figure 6:
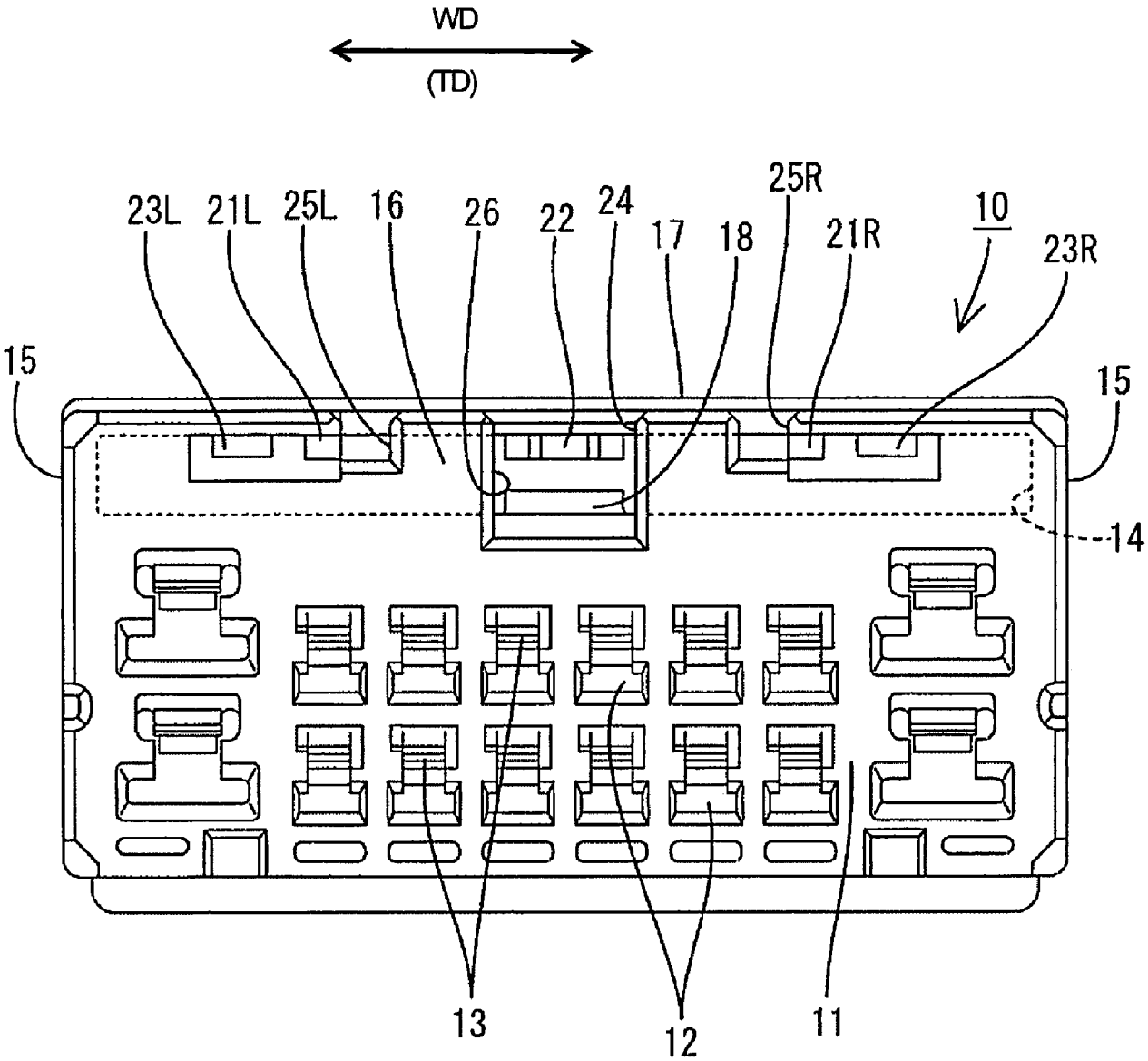
FIG. 6 is a front view of the first housing.
Figure 7:
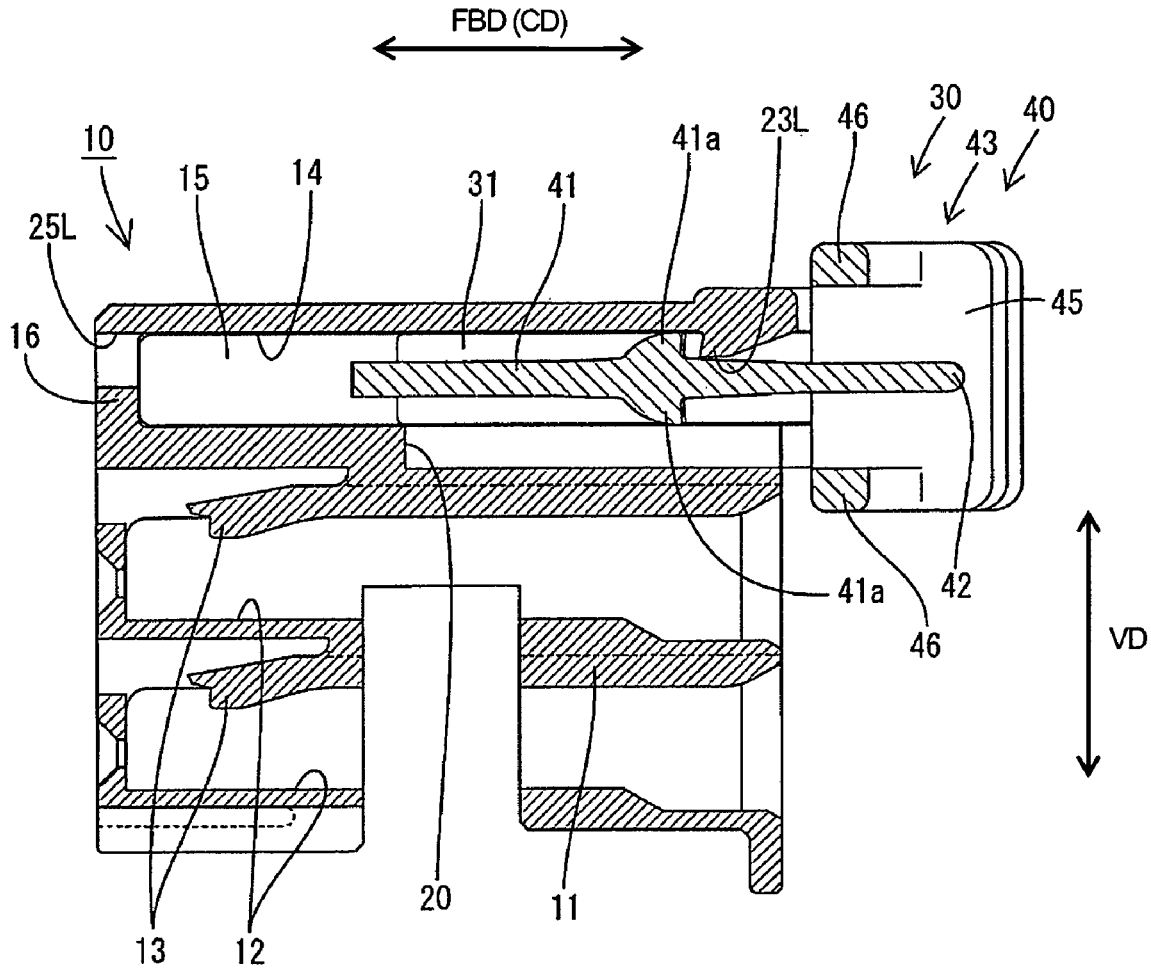
FIG. 7 is a section along 7-7 of FIG. 2.
Figure 8:
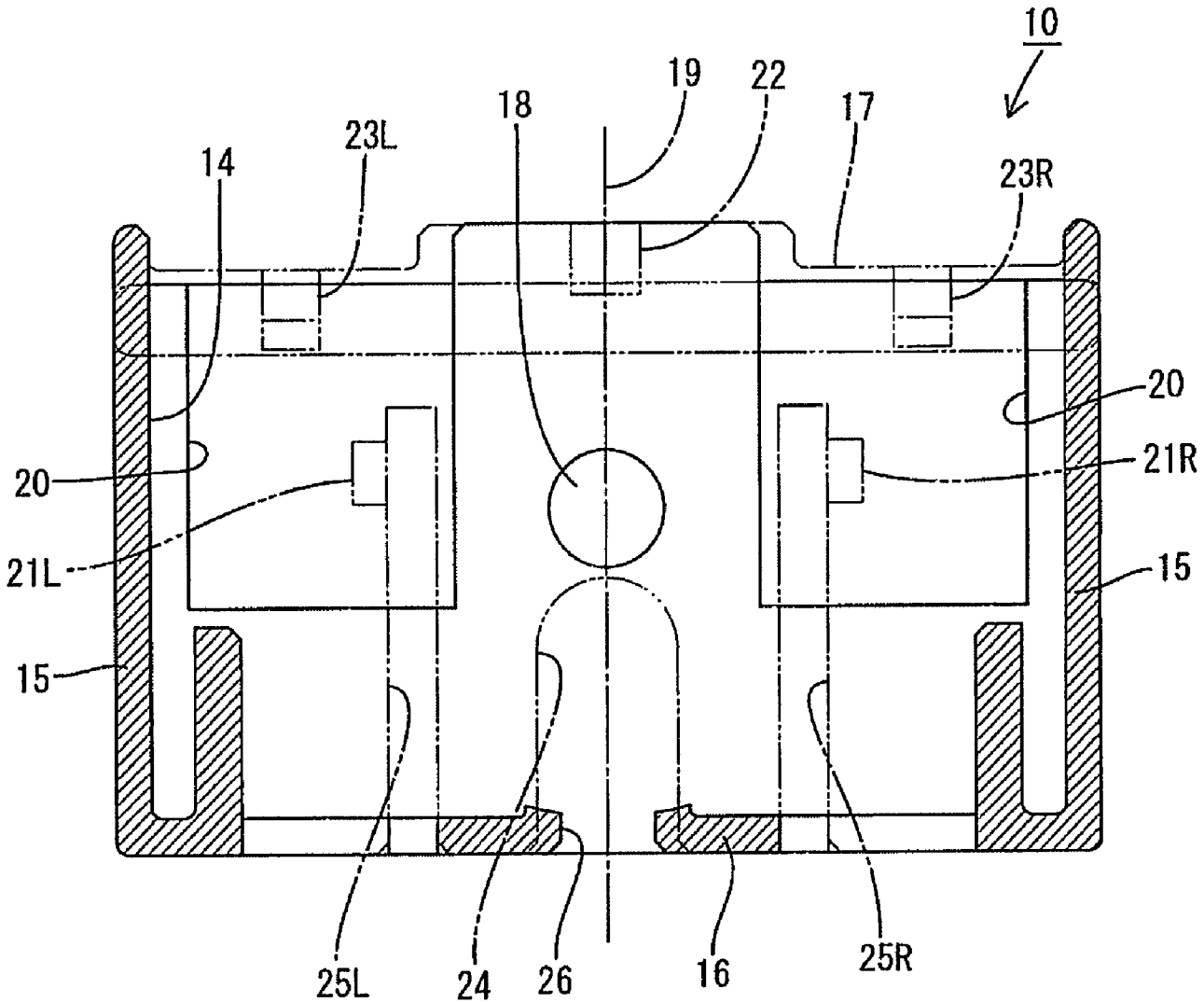
FIG. 8 is a horizontal section of the first housing.
Figure 9:
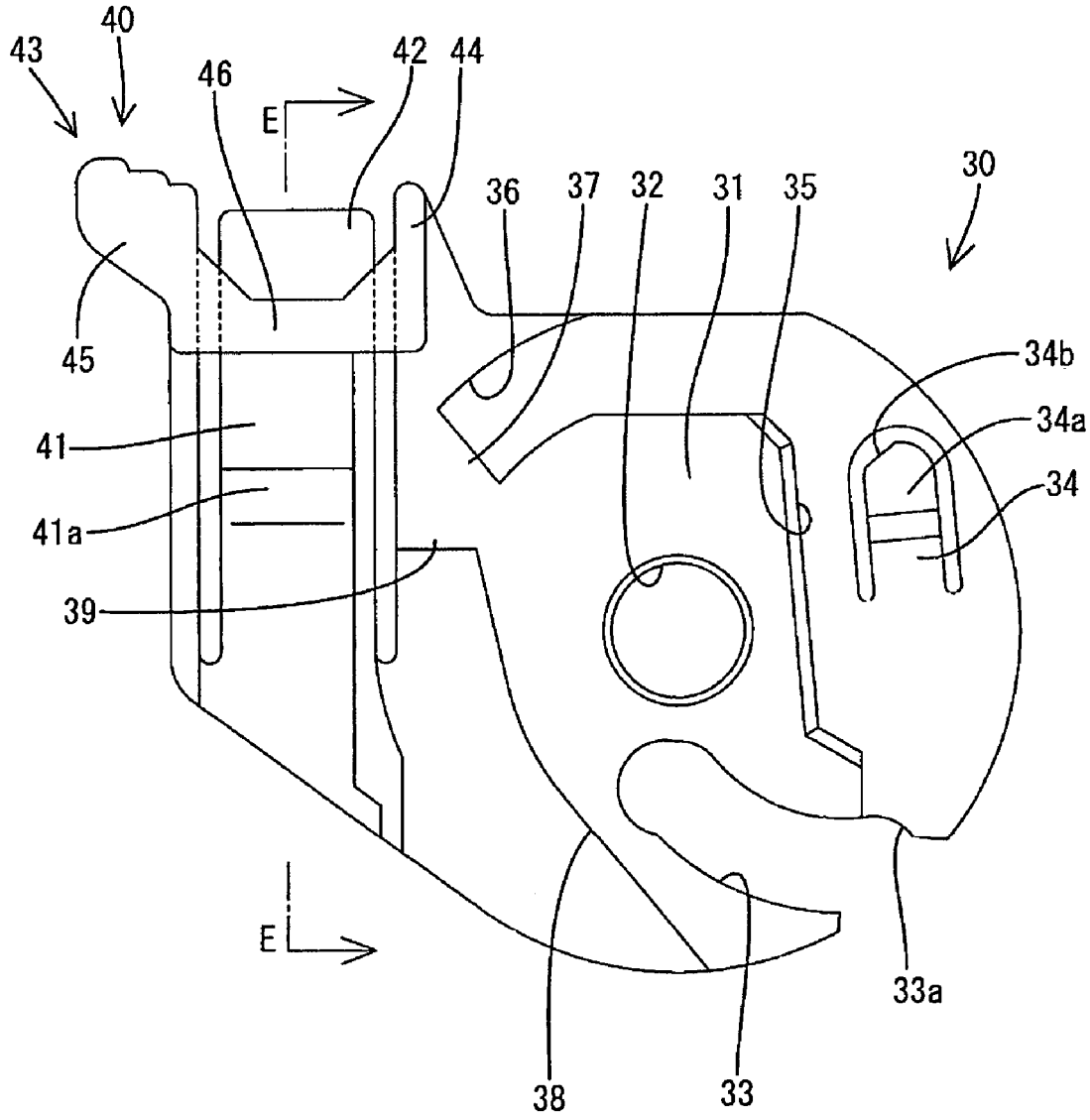
FIG. 9 is a plan view of the lever.
Figure 10:
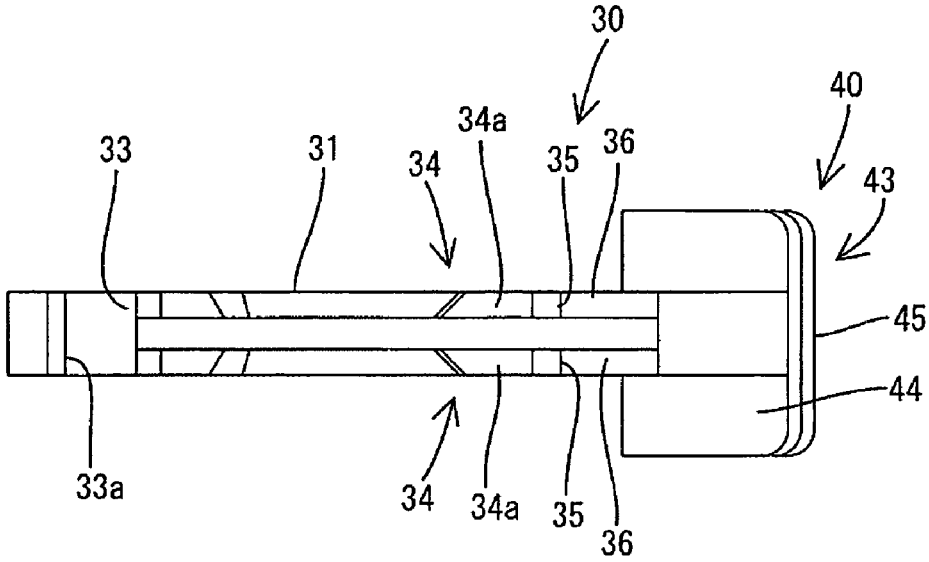
FIG. 10 is a right side view of the lever.
Figure 11:
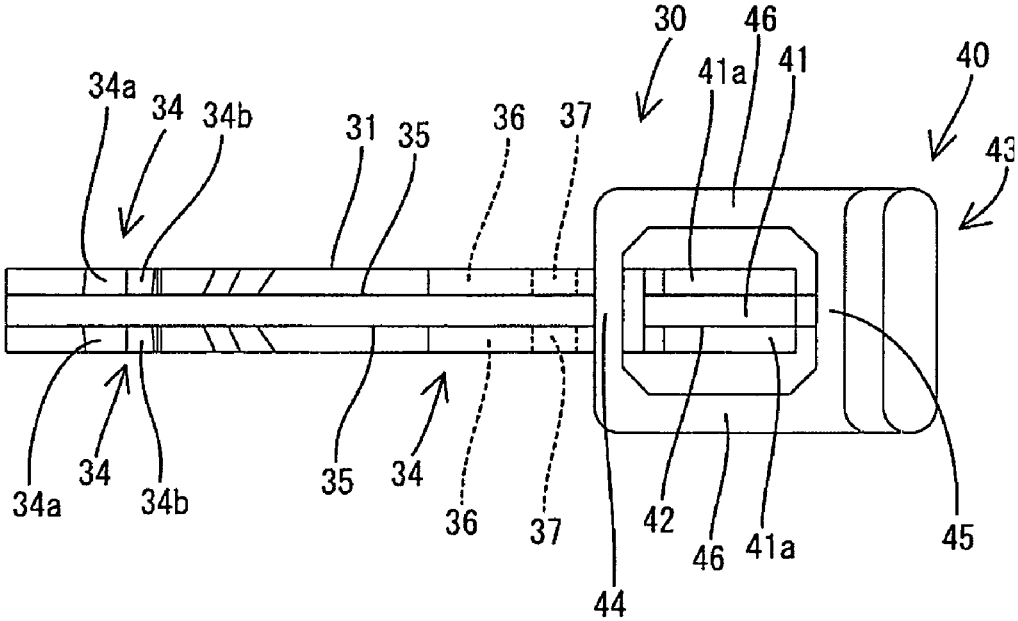
FIG. 11 is a rear view of the lever.
Figure 12:
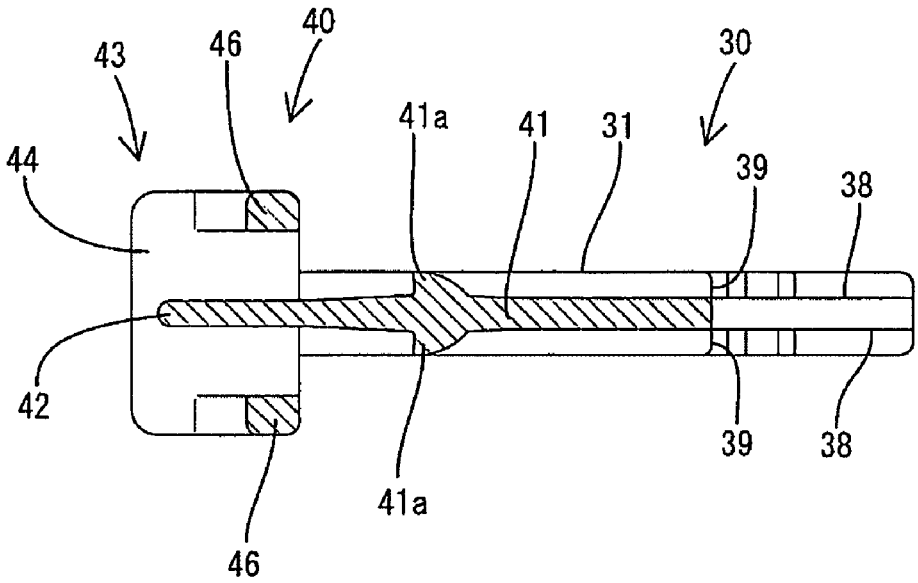
FIG. 12 is a section along 12-12 of FIG. 9.
Figure 13:
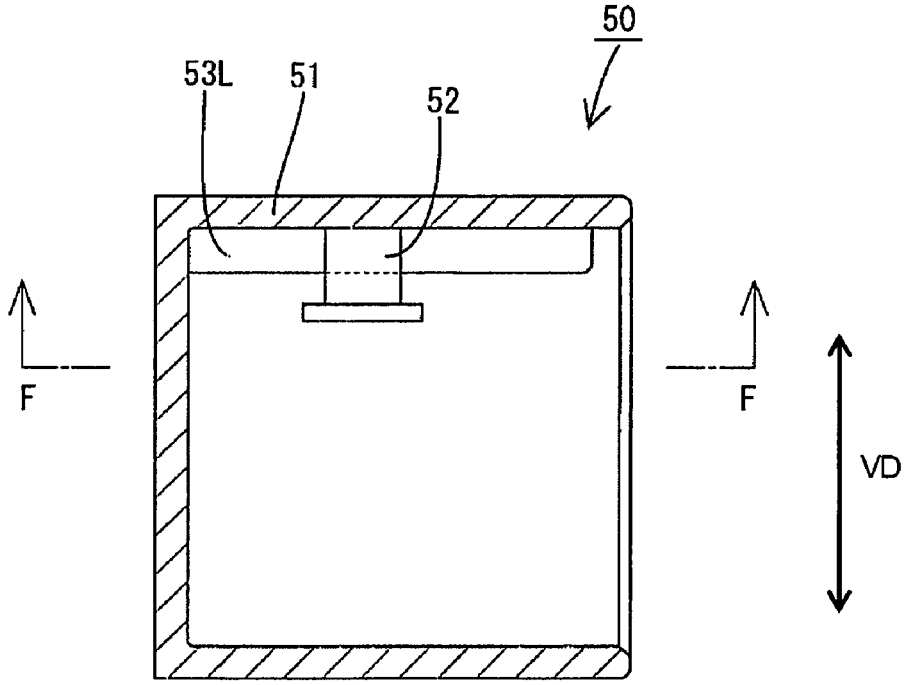
FIG. 13 is a vertical section of the second housing.
Figure 14:
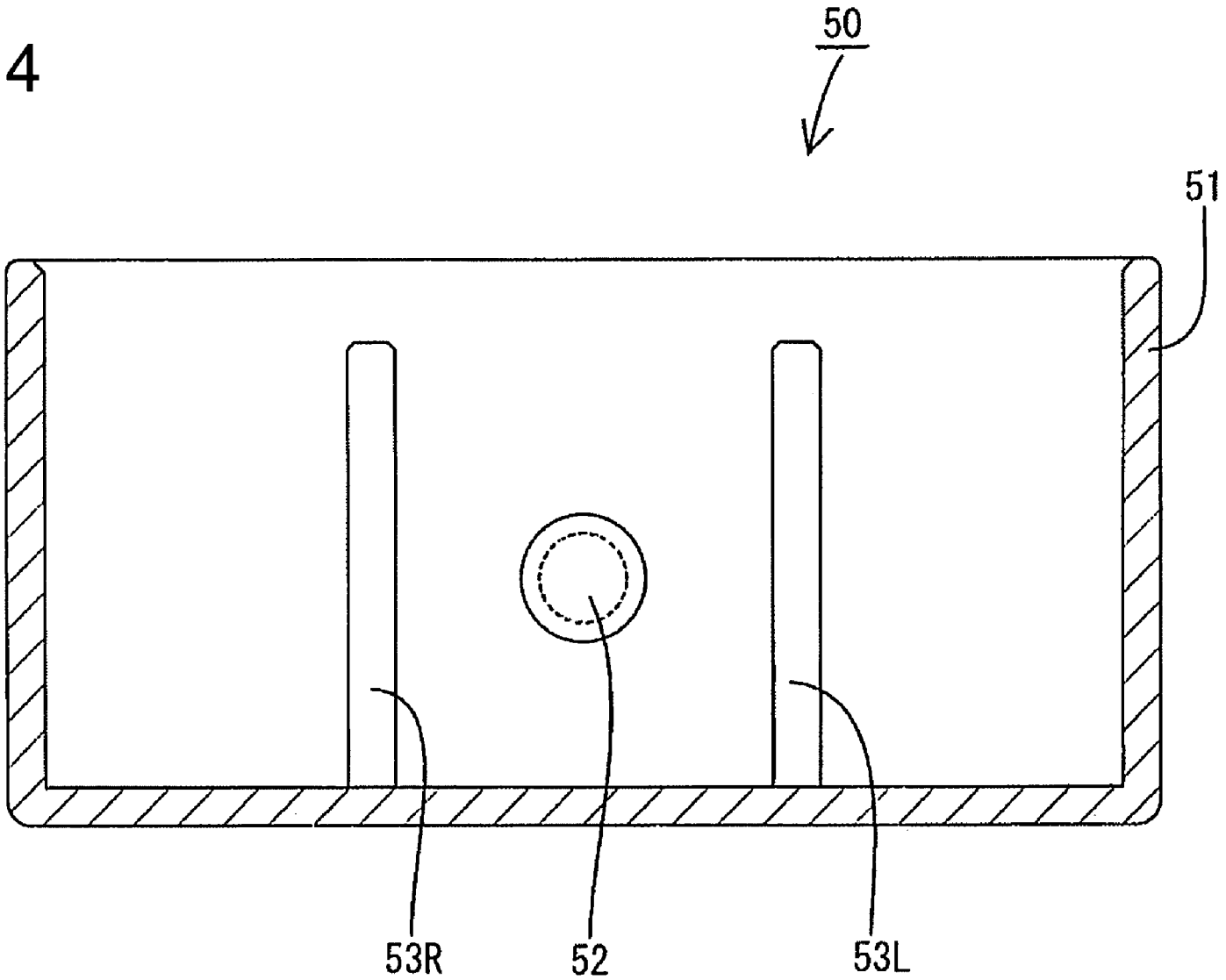
FIG. 14 is a section along 14-14 of FIG. 13.

The lever 30 is made e.g. of a synthetic resin and is substantially plate-shaped. The lever 30 includes a main body 31 and an operable portion 40 that are arranged substantially vertically symmetrically. The forward and backward directions FBD and the transverse direction TD are used herein to describe a state where the lever 30 is assembled with the first housing 10 at the connection position CP of FIG. 9, and this orientation of the lever 30 also is shown in FIG. 2.

The lever main body 31 is substantially circular in plan view. However, a substantially comb-shaped cut is made in a rear area of the peripheral edge. The lever main body 31 is slightly thinner than the height of the accommodation space 14. Thus, the lever main body 31 is displaceable in the accommodation space 14 without getting caught. A substantially round bearing hole 32 is formed substantially through the center of the lever main body 31 and a cam groove 33 is formed in the lever main body 31 before the bearing hole 32. The cam groove 33 extends oblique to both the circumferential and radial directions so that the cam groove 33 gradually approaches the bearing hole 32. An entrance 33*a* of the cam groove 33 is displaced slightly to the right from the front end of the outer peripheral edge of the lever main body 31.

The main body 31 has holding means for holding the lever 30 at the standby position SP. The holding means includes a front-stop holding means for preventing rotation of the lever 30 towards a connection position CP, and a reverse-rotation preventing holding means for preventing the lever 30 from being rotated in the direction opposite to the connection position CP. The front-stop holding means includes a resilient lock 34 formed by a substantially U-shaped slit in the main body 31 at a position obliquely back to the right with respect to the bearing hole 32. The resilient lock 34 is substantially flush with the main body 31 and cantilevers rearward. Accordingly, the resilient lock 34 is resiliently deformable up and down substantially normal to the connecting direction CD with the front end thereof as a support. Locking projections 34*a* project up and down at the extending rear end of the resilient lock 34. A substantially flat locking surface 34*b* is formed at a left area of the rear edge of each locking projection 34*a* and extends along a radial direction centered on the bearing hole 32. The main body 31 also has escaping portions 35 for holding by slicing off the upper and lower surfaces of the main body 31. Each escaping portion 35 extends from an area around the resilient lock 34 and at the right side of the bearing hole 32 to an area behind the bearing hole 32. Additionally, each escaping portion 35 is open at the outer peripheral edge of the main body 31. An arcuate portion 36 is formed at a rear area of each escaping portion 35 and is substantially concentric with the bearing hole 32. The arcuate portion 36 projects obliquely forward to left, and is not open at the outer peripheral edge of the lever main body 31. A contact 37 is formed at the left-front end of the arcuate portion 36 and functions as the reverse-rotation preventing holding means.

The main body 31 also has locking means for locking the lever 30 at the connection position CP. The locking means includes a front-stop locking means for preventing the lever 30 from being rotated towards the side opposite to the standby position SP, and return-preventing locking means for preventing the lever 30 from being rotated towards the standby position SP. Escaping portions 38 are formed by slicing off parts of the upper and lower surfaces of the main body 31. Each escaping portion 38 extends from an area at the left side of the cam groove 33 to an area at the left side of the bearing hole 32 and is open at the outer peripheral edge of the main body 31. A contact 39 is defined at the rear end of the escaping portion 38 and functions as the front-stop locking means. The operable portion 40 bulges out unitarily at a left end of the outer peripheral edge of the lever main body 31. The operable portion 40 is comprised of a resilient lock 41 and a protecting portion 43.

Left and right slits extend substantially straight forward from the rear edge of the operable portion 40 to front positions slightly more backward from the front end of the operable portion 40. Thus, the resilient lock 41 is cantilevered substantially backward while having the front end thereof supported on the lever main body 31. The resilient lock 41 is a substantially rectangular plate that is long along forward and backward directions FBD. Additionally, the resilient lock 41 is substantially flush with the main body 31. A finger placing portion 42 is defined at the extending rear end of the resilient lock 41. The finger placing portion 42 has a specified width along the transverse direction TD so that fingers can be placed easily on the finger placing portion 42 from above or from below. The finger placing portion 42 projects more backward than the rear end of the main body 31. Lock projections 41*a* project up and down at an intermediate position of the resilient lock piece 41 with respect to forward and backward directions FBD and has a pointed or substantially triangular cross section. The upper and lower lock projections 41*a* are substantially vertically symmetrical. The resilient lock 41 can make resiliently deformable pivoting movements up and down in the thickness direction of the lever 30 with the front end thereof as a support.

The protecting portion 43 includes an inner wall 44 arranged along the right edge of the finger placing portion 42, an outer wall 45 arranged along the left edge of the finger placing portion 42, arid upper and lower couplings 46 that couple the upper ends and the bottom ends of the inner and outer walls 44, 45. The inner wall 44, the outer wall 45 and the couplings 46 form a substantially rectangular frame that surrounds the finger placing portion 42 at upper, lower, left and right sides. The rear edges of the inner and outer walls 44, 45 project more backward than the rear end of the finger placing portion 42 to prevent interference of external matter with the finger placing portion 42 from behind, left and right sides. Vertical dimensions of the inner and outer walls 44, 45 are sufficiently larger than those of the resilient lock 41, the finger placing portion 42 and the main body 31. Therefore, the protecting portion 43 projects up and down with respect to the resilient lock 41 and the lever main body 31, and external matter cannot interfere with the finger placing portion 42 from above and below. On the other hand, the couplings 46 that couple the front ends of the inner and front walls 44, 45 are before the rear end of the finger placing portion 42. Thus, the finger placing portion 42 is exposed up and down behind the couplings 46. Hence, fingers can be placed on the finger placing portion 42 from above and/or below without being hindered by the couplings 46. Similar to the finger placing portion 42, the protecting portion 43 projects more backward than the rear edge of the main body 31.

The second housing 50 is made e.g. of a synthetic resin and includes a receptacle 51 in the form of a wide rectangular tube. The first housing 10 is accommodated in the receptacle 51 upon connecting the two housings 10, 50. Tabs (not shown) of male terminal fittings project forward in the receptacle 51. A substantially cylindrical cam follower 52 projects down and in at a transverse middle position of the lower surface of the upper wall of the receptacle 51 and has a center axis that extends substantially along the vertical direction VD. Long narrow left and right freeing ribs 53L, 53R are formed on the lower surface of the upper wall of the receptacle 51 at the left and right sides of the cam follower 52. The freeing ribs 53L, 53R extend substantially straight in forward and backward directions FBD and substantially parallel with the connecting direction CD with the first housing 10. Additionally, the freeing portions 53L, 53R are substantially transversely symmetrical with respect to the axis of symmetry 19.

The lever 30 is held substantially in the posture for the connection position CP and is inserted from behind into the accommodation space 14 of the first housing 10 to begin assembly of the connector. The upper wall 17 of the accommodation space 14 deforms up and out upon during this assembly of the lever 30 with the first housing 10. As a result, the bearing hole 32 can move into alignment with the supporting shaft 18 from above. The upper wall 17 and the main body 31 of the lever 30 are restored resiliently from their warped states substantially to their flat states when the bearing hole 32 is fit onto the supporting shaft 18. Thus, the lever 30 is assembled rotatably about the supporting shaft 18 of the first housing 10.

The lever 30 then is rotated counterclockwise to the standby position SP shown in FIG. 1. As a result, the entrance 33*a* of the cam groove 33 substantially corresponds to the first escaping groove 24 and the insertion opening 26. Rotation of the lever 30 causes the reverse-rotation preventing portion 22 to move counterclockwise relative to the lever 30 in the escaping portion 35 and causes the left front-stop 21L to move counterclockwise relative to the lever 30 in the escaping portion 38. Additionally, the resilient lock 34 deforms down into the right deformation space 20 and passes the right front-stop 21R as the lever 30 is rotated. The contact 37 on the upper surface engages the reverse-rotation preventing portion 22 in the clockwise direction when the lever 30 reaches the standby position SP and prevents the lever 30 from rotating towards the side opposite the connection position CP (clockwise in FIG. 1). Additionally, the resilient lock 34 is restored resiliently up and out so that the locking surfaces 34*b* engage the right front-stop 21R in the counterclockwise direction to prevent the lever 30 from being rotated towards the connection position CP. Thus, the lever 30 is held at the standby position SP and the rotation in both forward and reverse directions is prevented.

The receptacle 51 of the second housing 50 is fit lightly on the first housing 10 in this state. As a result, the cam follower 52 moves through the insertion opening 26 and the first escaping groove 24 and into the entrance 33*a* of the cam groove 33. Accordingly, the freeing portions 53L, 53R enter the accommodation space 14 and fit into the second escaping grooves 25L, 25R. Furthermore, the front end of the right freeing portion 53R contacts the upper locking projection 34*a* of the resilient lock 34 to deform the resilient lock 34 down sufficiently for the locking projection 34*a* to disengage from the front-stop 21R, as shown in FIG. 1. In this way, rotation of the lever 30 from the standby position SP towards the connection position CP is permitted.

The lever 30 then is rotated counterclockwise about the supporting shaft 18 preferably by more than about 25°, and more preferably by about 40°. This rotation is achieved by operating the protection 43 of the operable portion 40 until the lever 30 reaches the connection position CP shown in FIG. 2. The cam groove 33 and the cam follower 52 remain engaged as the lever 30 rotates towards the connection position CP and generate a cam action or force multiplying action that strongly pulls the first and second housings 10, 50 together and into a properly connected state. Further, the reverse-rotation preventing portion 22 moves clockwise relative to the lever 30 in the escaping portion 35, and the left front-stop 21L moves clockwise relative to the lever 30 in the escaping portion 38. Additionally, the resilient lock 41 deforms resiliently down and into the left deformation space 20 so that the lock projections 41*a* can pass the left front-stop 21L.

The upper contact 39 engages the left front-stop 21L in the counterclockwise direction when the lever 30 reaches the connection position CP and prevents the lever 30 from rotating towards the side opposite to the standby position SP. Additionally, the lock projections 41*a* of the resilient lock 41 engage the corresponding left return preventing portion 23L in the clockwise direction and prevent the lever 30 from rotating in a returning direction towards the standby position SP. Thus, the lever 30 is locked at the connection position CP and both forward and reverse rotations are prevented. The resilient lock 34 is moved to a position where the locking projections 34*a* avoid interference with the right freeing portion 53R and the right front-stop 21R. Thus, the resilient lock 34 restores resiliently to be substantially flush with the main body 31. The lower surfaces of the left and right freeing portions 53L, 53R are lower than the upper surface of the main body 31. However, the escaping portions 35 for holding and the escaping portion 38 for locking are provided in the entering areas of the right and left freeing portions 53R, 53L. Therefore, the freeing portions 53L, 53R and the main body 31 do not interfere with each other.

The two locked housings 10, 50 can be separated by placing fingers on the finger placing portion 42 from above to resiliently deform the resilient lock 41 down and into the left deformation space 20. Thus, the upper lock projection 41*a* disengages from the corresponding left return preventing portion 23L, and the lever 30 can rotate from the connection position CP towards the standby position SP. The protecting portion 43 of the operable portion 40 then is operated while keeping this unlocked state to rotate the lever 30 clockwise. The cam groove 33 engages the cam follower 52 during this rotation and generates a cam action to push the second housing back away from the first housing 10. The two housings 10, 50 reach the initially fitted state shown in FIG. 1 when the lever 30 reaches the standby position SP. Thus, the cam follower 52 is at the entrance 33*a* of the cam groove 33. Fingers may be lifted from the finger placing portion 42 after the lock projections 41*a* pass the left return preventing portion 23L. As a result, the resilient lock 41 is restored resiliently after reaching the initially filled state, and the two housings 10, 50 may be separated from each other.

The reverse-rotation preventing portion 22 moves counterclockwise relative to the lever 30 in the escaping portion 35 for holding and the left front-stop 21L moves counterclockwise relative to the lever 30 in the escaping portion 38 for locking as the lever 30 rotates towards the standby position SP. Additionally, the resilient lock 34 is deformed down into the right deformation space 20 so that the locking projections 34*a* can pass the right front stop 21R.

The main body 31 of the lever 30 is in the accommodation space 14 when the lever 30 is at the standby position SP, at the connection position CP or in the process of rotating between the standby position SP and the connection position CP. Most of the operable portion 40 is exposed outside the accommodation space 14 when the lever 30 is at the standby position SP. The operable portion 40 gradually moves into the accommodation space 14 from the front end as the lever is rotated from the standby position SP to the connection position CP. Additionally, only the finger placing portion 42 and the protecting portion 43 of the operable portion 40 are exposed outside the accommodation space 14 when the lever 30 reaches the connection position CP.

The lever 30 is rotated counterclockwise from the standby position SP to the connecting portion CP and the operable portion 40 is at the left end when the lever 30 is at the connection position CP in the above description. However, the lever 30 can function as a force multiplier even if assembled to the first housing 10 in a transversely reversed posture. More particularly, the lever 30 is substantially vertically symmetrical. Additionally, the entrance 33*a* of the cam groove 33 is on the axis of symmetry 19, which passes through the supporting shaft 18 for the lever 30 when the lever 30 is at the standby position SP. Furthermore, the front-stops 21L, 21R are at two positions substantially symmetrical with respect to the axis of symmetry 19, the reverse-rotation preventing portion 22 is substantially on the axis of symmetry 19; and the front-stops 21L, 21R and the return preventing portions 23L, 23R are at two positions substantially symmetrical with respect to the axis of symmetry 19.

Figure 15:
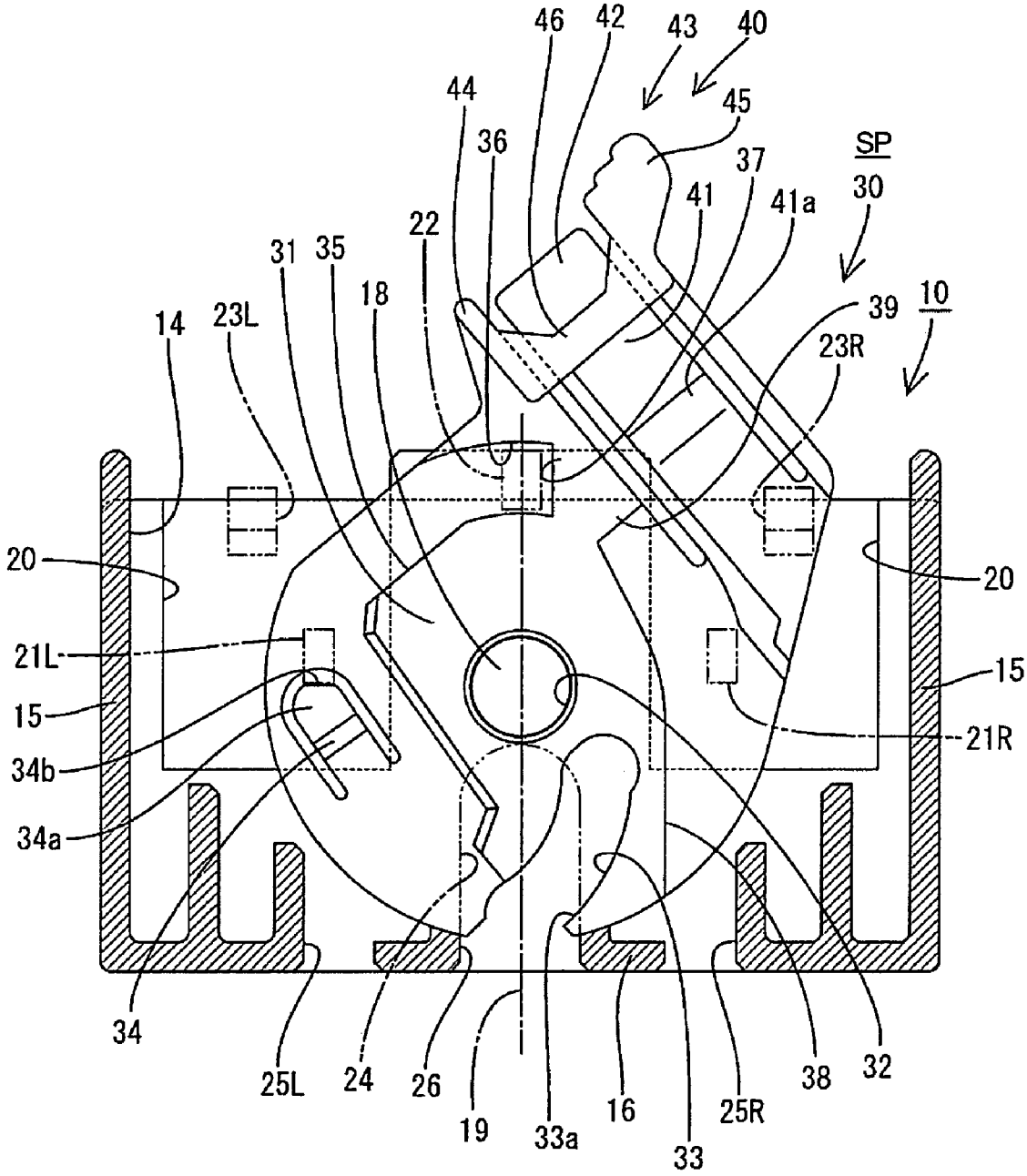
FIG. 15 is a horizontal section showing a state where the lever assembled in a reversed posture with respect to that in FIG. 1 is held at a standby position.
Figure 16:
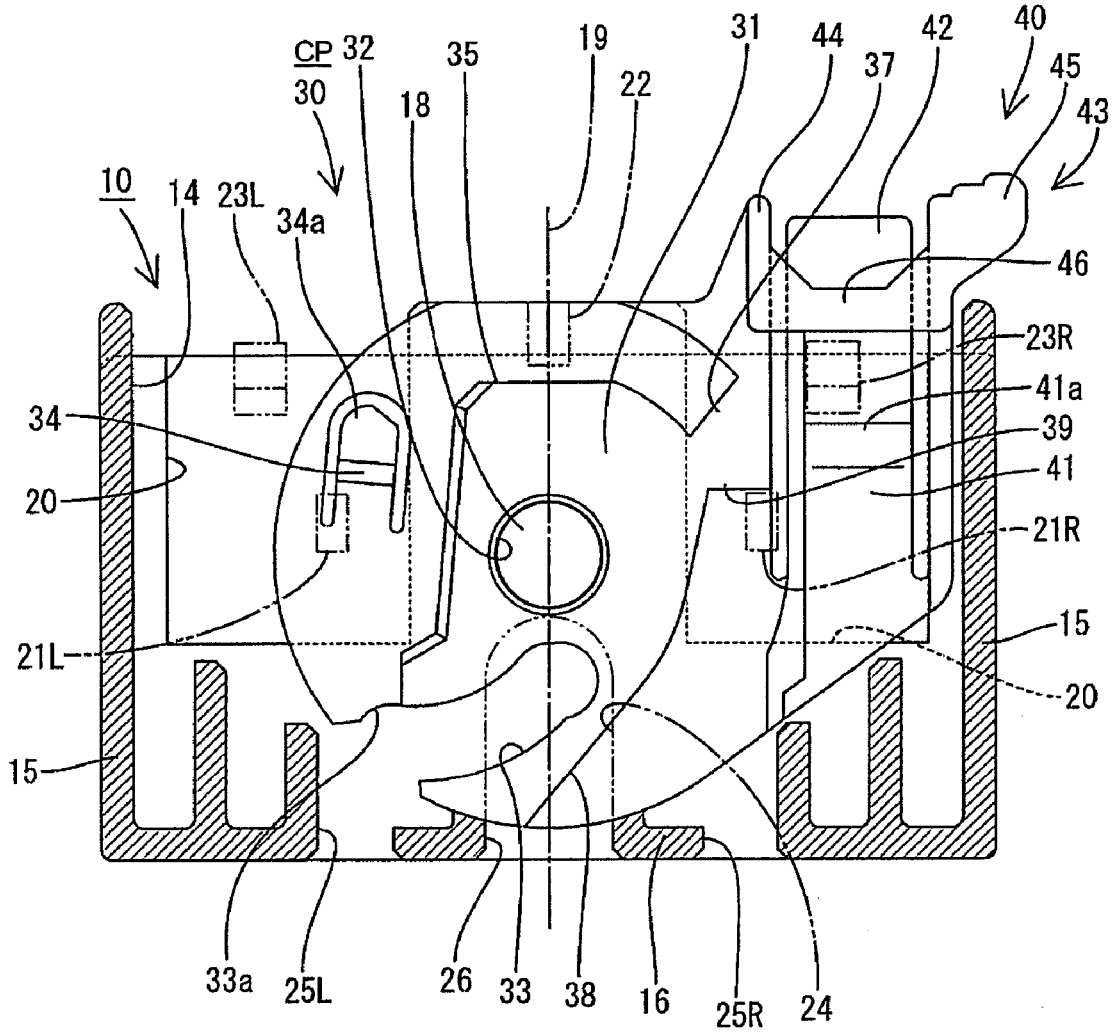
FIG. 16 is a horizontal section showing a state where the lever assembled in a reversed posture with respect to that in FIG. 2 is locked at a connection position.

FIGS. 15 and 16 show the lever 30 is in a reversed posture where the lever 30 is rotated clockwise from the standby position SP to the connection position CP and the operable portion is at the right end when the lever 30 is at the connection position CP. FIG. 15 shows the lever 30 at the-standby position SP, while FIG. 16 shows the lever 30 at the connection position CP. Both states shown in FIGS. 15 and 16 are substantially transversely symmetrical to those shown in FIGS. 1 and 2. The functions of the holding means for holding the lever 30 at the standby position SP and the means for locking the lever 30 at the connection position CP are also substantially transversely symmetrical to the above corresponding means. Accordingly, the functions of the holding means and the locking means are not described here.

As described above, the lever 30 can be assembled with the first housing 10 in either of the two postures substantially symmetrical to the axis of symmetry 19. The rotating direction of the lever 30 is changed by transversely reversing the assembling posture of the lever 30. Thus, the rotation operability of the lever 30 can be improved by selecting the assembling posture of the lever 30 depending on circumstances in which the connector is used.

The lever 30 is a single horizontal plate and is smaller in the vertical direction VD than a U-shaped lever that has arms at opposite ends of an operable portion. Further, the cam follower 52 can enter the cam groove, the lever 30 can be held at the standby position SP by the holding means, and the lever 30 can be locked at the connection position CP by the locking means regardless of the assembly posture of the lever 30.

Further, the reverse-rotation preventing portion 22 is arranged on the axis of symmetry 19, and can function as a common reverse-rotation preventing holding means even if the posture of the lever 30 is changed. Accordingly, the shape of the first housing 10 in the accommodation space 14 can be simplified as compared to a case where reverse-rotation preventing portions are provided at two positions substantially symmetrical with respect to the axis of symmetry 19.

One of the left and right front-stops 21L, 21R functions as the front-stop holding means, and the other thereof functions as the front-stop locking means. The front-stop 21L, 21R that had functioned as the front-stop holding means functions as the front-stop locking means if the lever 30 is assembled in the reversed posture, and the one that had functioned as the front-stop locking means functions as the front-stop holding means. In this way, the respective front-stops 21L, 21R fulfill two functions depending on the assembling posture of the lever 30. Accordingly, the shape of the first housing 10 in the accommodation space 14 can be simplified as compared to a case where the respective front-stops fulfill only one function.

The plate-shaped resilient lock 41 has a wide finger placing area to make it easier to place fingers. The resilient lock 41 is resiliently deformable substantially in the same direction as the thickness direction of the lever 30. Thus, the finger placing area has a surface substantially parallel with the plate surface of the lever 30. Accordingly, the lever 30 is not made thicker even if the resilient lock 41 is made wider.

The protecting portion 43 at least partly surrounds the resilient lock 41, it is unavoidable to locally enlarge only the protecting portion 43 in the operable portion 40. If the accommodation space 14 is enlarged to have a higher height to permit the protecting portion 43 to be displaced in the accommodation space 14, a large dead space corresponding to the lever main body 31 is formed in the accommodation space 14, with the result that the entire first housing 10 unnecessarily becomes larger. However, since the protecting portion 43 is displaceable outside the accommodation space 14 in this embodiment. Thus, the accommodation space 14 is smaller (to have a shorter height) and to miniaturize the first housing 10 can be miniaturized.

Figure 29:
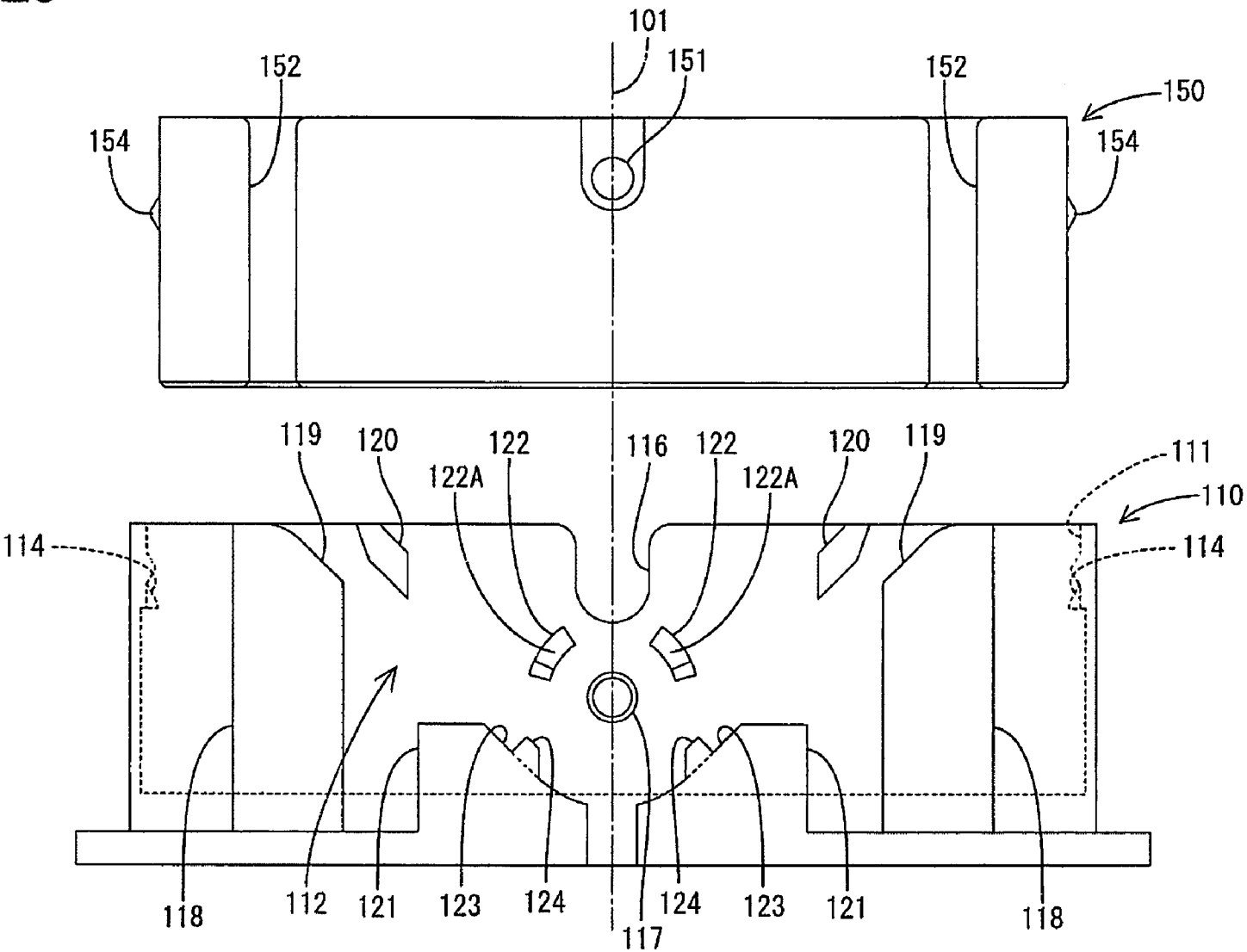
FIG. 29 is a side view showing a state before the second housing is initially fitted on the first housing.
Figure 30:
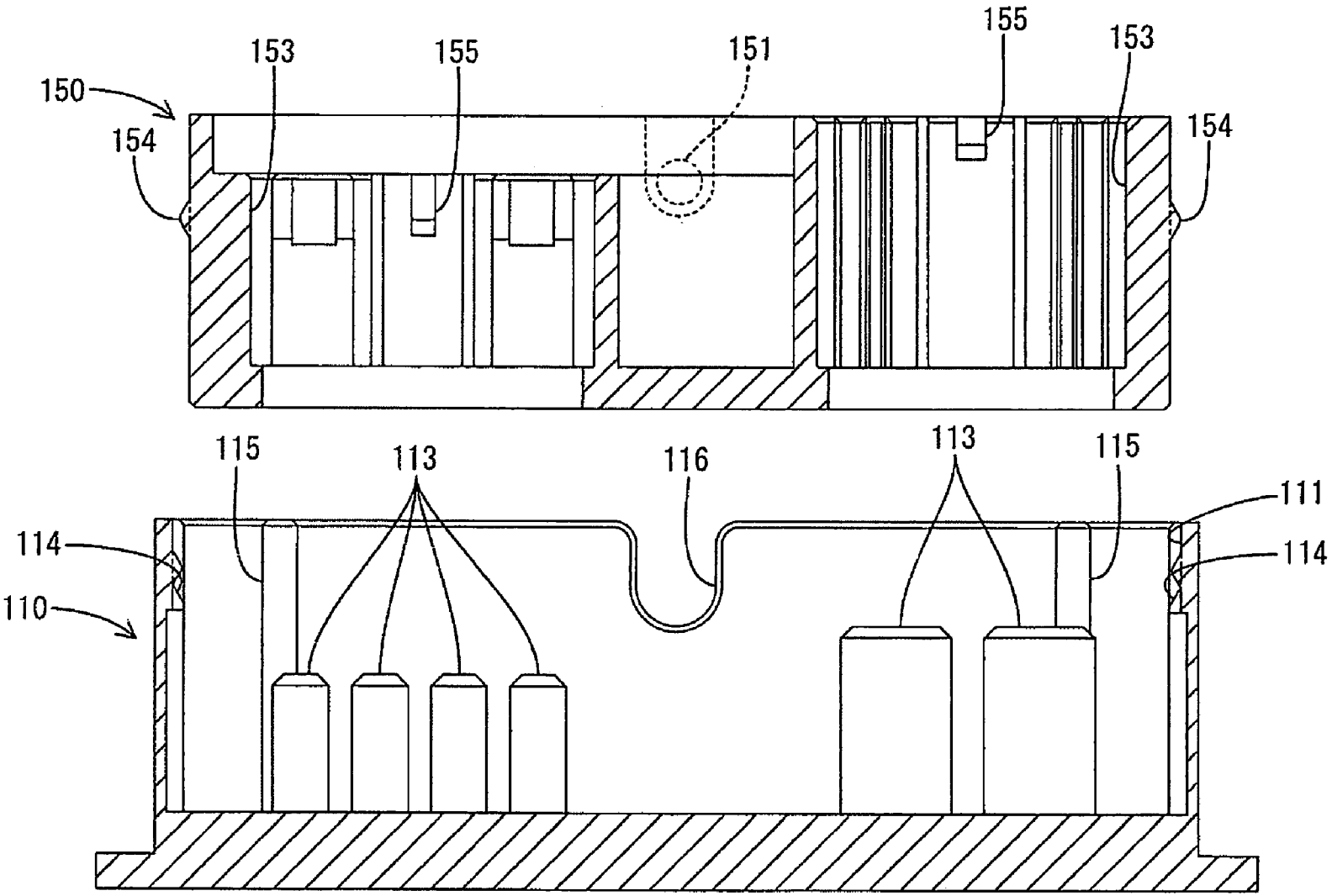
FIG. 30 is a section showing the state of FIG. 29.

A second embodiment of the connector is described with reference to FIGS. 17 to 33. The connector of the second embodiment has a first housing 110 made e.g. of a synthetic resin. The first housing 110 has a wide rectangular tubular receptacle 111 configured for receiving a second housing 150, as shown in FIGS. 26 and 29. Tabs 113 of differently dimensioned male terminal fittings project forward in the receptacle 111, as shown in FIGS. 26 and 30. Wires (not shown) are connected with rear ends of the male terminal fittings and can be drawn out backward from the first housing 110. Guide projections 115 are provided on the inner peripheral surface of the receptacle 111 and extend in forward and backward directions FBD. On the other hand, guide recesses 152 are formed in the outer peripheral surface of the second housing 150 at positions corresponding to the respective guiding projections 115 during connection of the two housings 110, 150. Thus, an erroneous upside-down connection of the two housings 110, 150 can be prevented.

Mounting surfaces 112 are defined on the outer surfaces of the receptacle 111 corresponding to the longer sides of the opening edge of the receptacle 111. A substantially cylindrical supporting shaft 117, two guiding projections 118, two receiving portions 121 and two detaching portions 122 are formed on each mounting surface 112. The supporting shafts 117 project out substantially in the center of each mounting surface 112 and have center axes that extend substantially along the width direction WD. An axis of symmetry 101 passes through the center axis of the supporting shaft 117 and substantially parallel with the connecting direction CD of the two housings 110, 150. The mounting surfaces 112 are transversely substantially symmetrical with respect to the axis of symmetry 101 (see FIG. 29).

The guiding projections 118 project at the opposite left and right ends of each mounting surface 112, and extend substantially along the connecting direction CD of the two housings 110, 150. Slanted guiding surfaces 119 are formed at the front inner corners of the guiding projections 118. Further, guides 120 project at the inner sides of the guiding projections 118 towards the axis of symmetry 101 and at the front end of the receptacle 111. The guides 120 extend substantially parallel with the guiding surfaces 119.

A substantially U-shaped escaping groove 116 is formed on the axis of symmetry 101 and extends back from the front edge of the receptacle 111 (see FIG. 29).

The receiving portions 121 project at positions near the axis of symmetry 101 at the rear end of the receptacle 111. Each receiving portion 121 has an arcuate inclined surface 123 substantially centered on the supporting shaft 117. An auxiliary stopper 124 is provided substantially in the middle of each inclined surface 123.

Two detaching portions 122 are provided obliquely forward of the supporting shaft 117 to the left and right, and extend in a circumferential direction with the supporting shaft 117 as a center. Each detaching portion 122 has a sliding-contact surface 122A that slopes up and away from the axis of symmetry 101.

Figure 17:
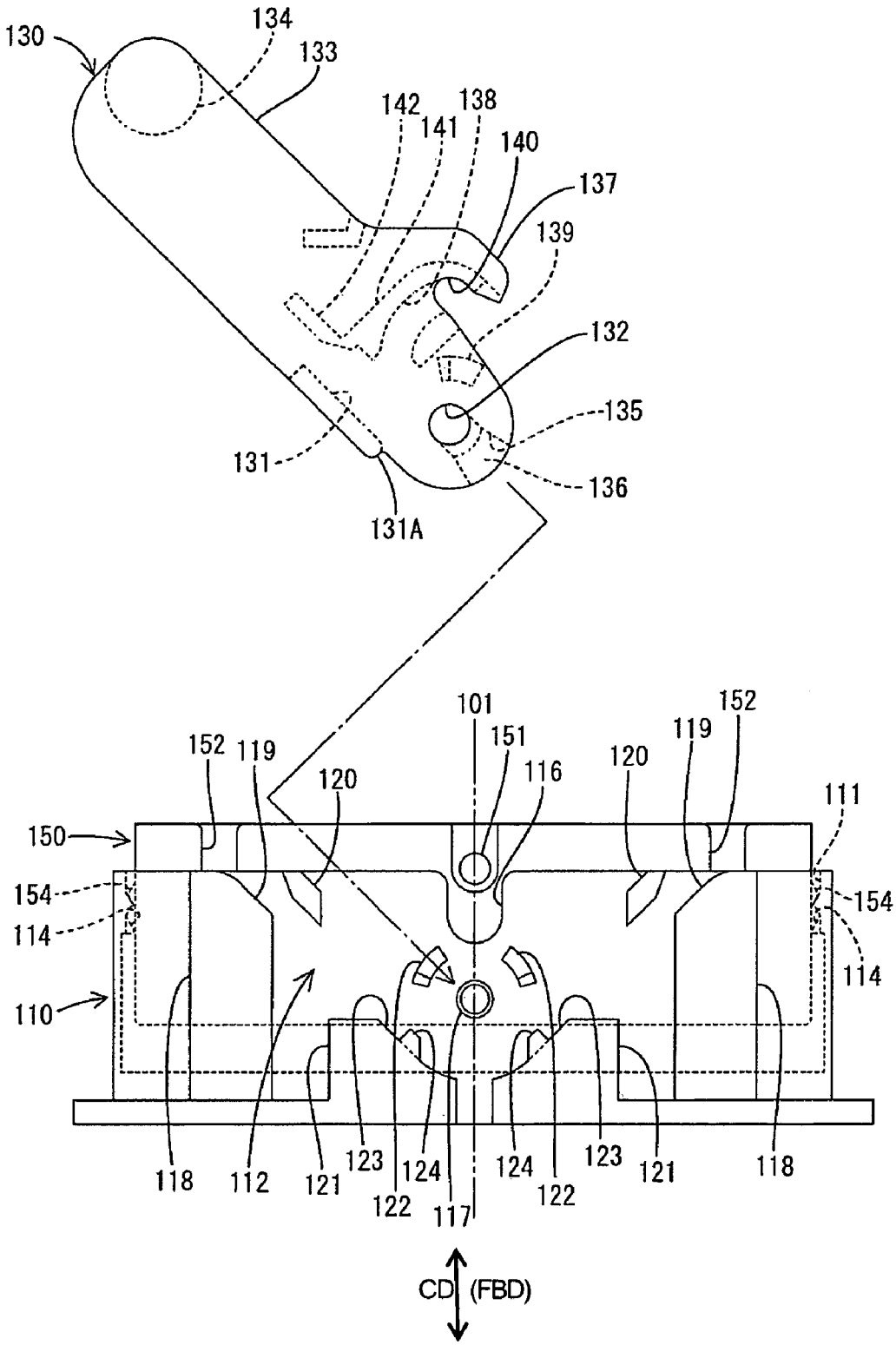
FIG. 17 is a side view showing an initially fitted state of a second housing before a lever is assembled in a second embodiment.
Figure 18:
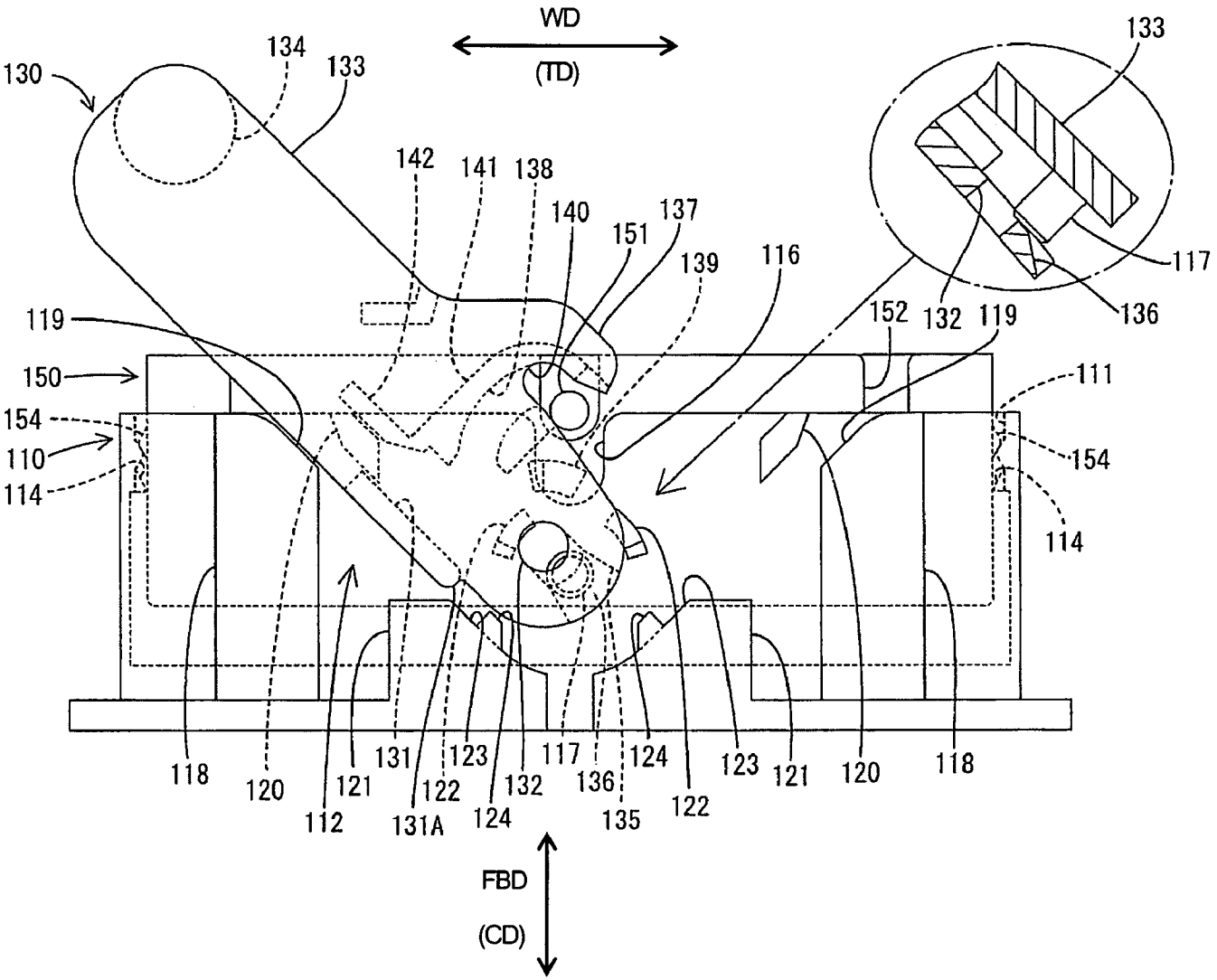
FIG. 18 is a side view showing the initially fitted state of the second housing immediately before the lever is assembled.
Figure 19:
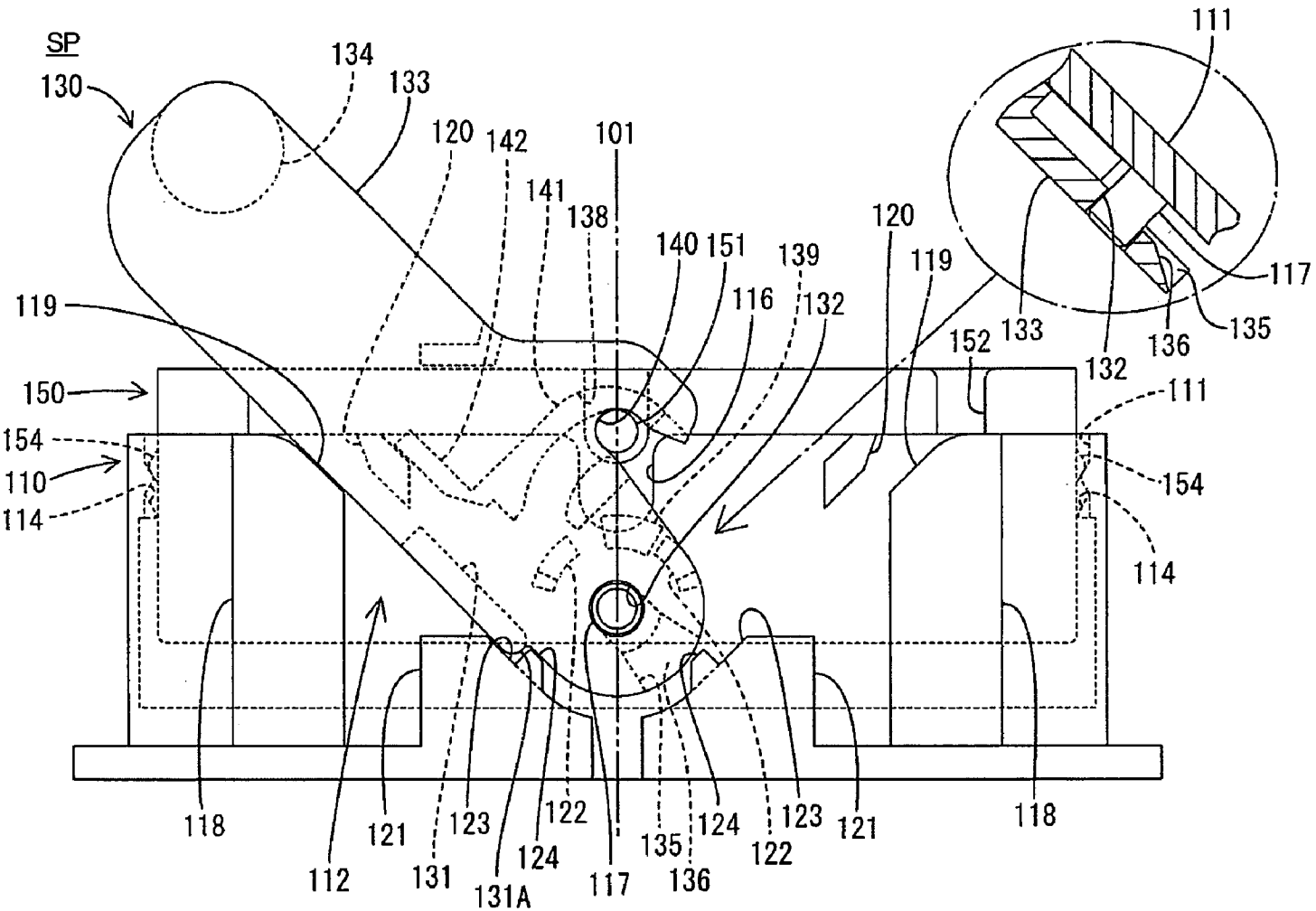
FIG. 19 is a side view showing the initially fitted state of the second housing with the lever held at a standby position.
Figure 23:
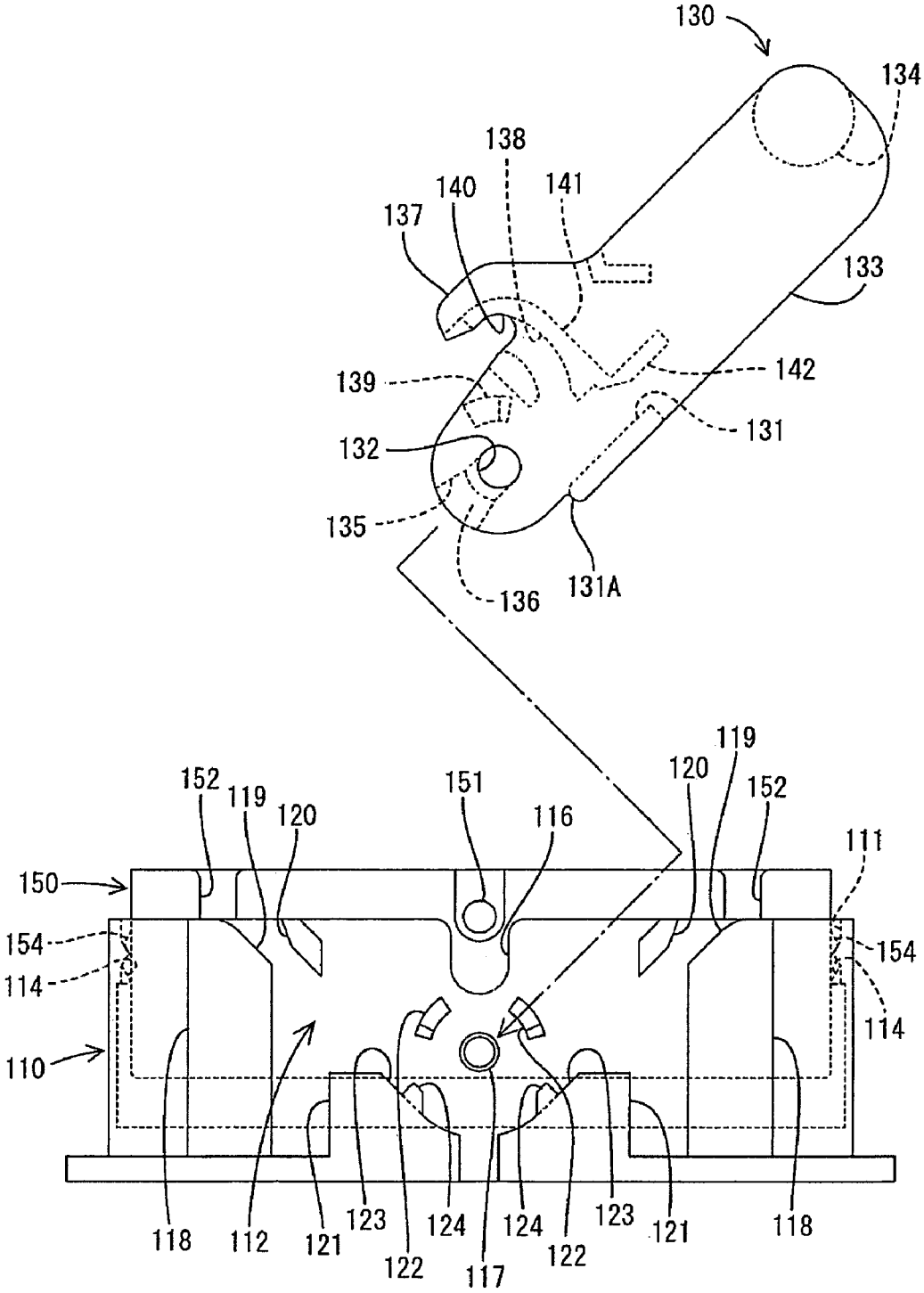
FIG. 23 is a side view showing a state before the lever is assembled in a reversed posture with respect to that in FIG. 17.
Figure 24:
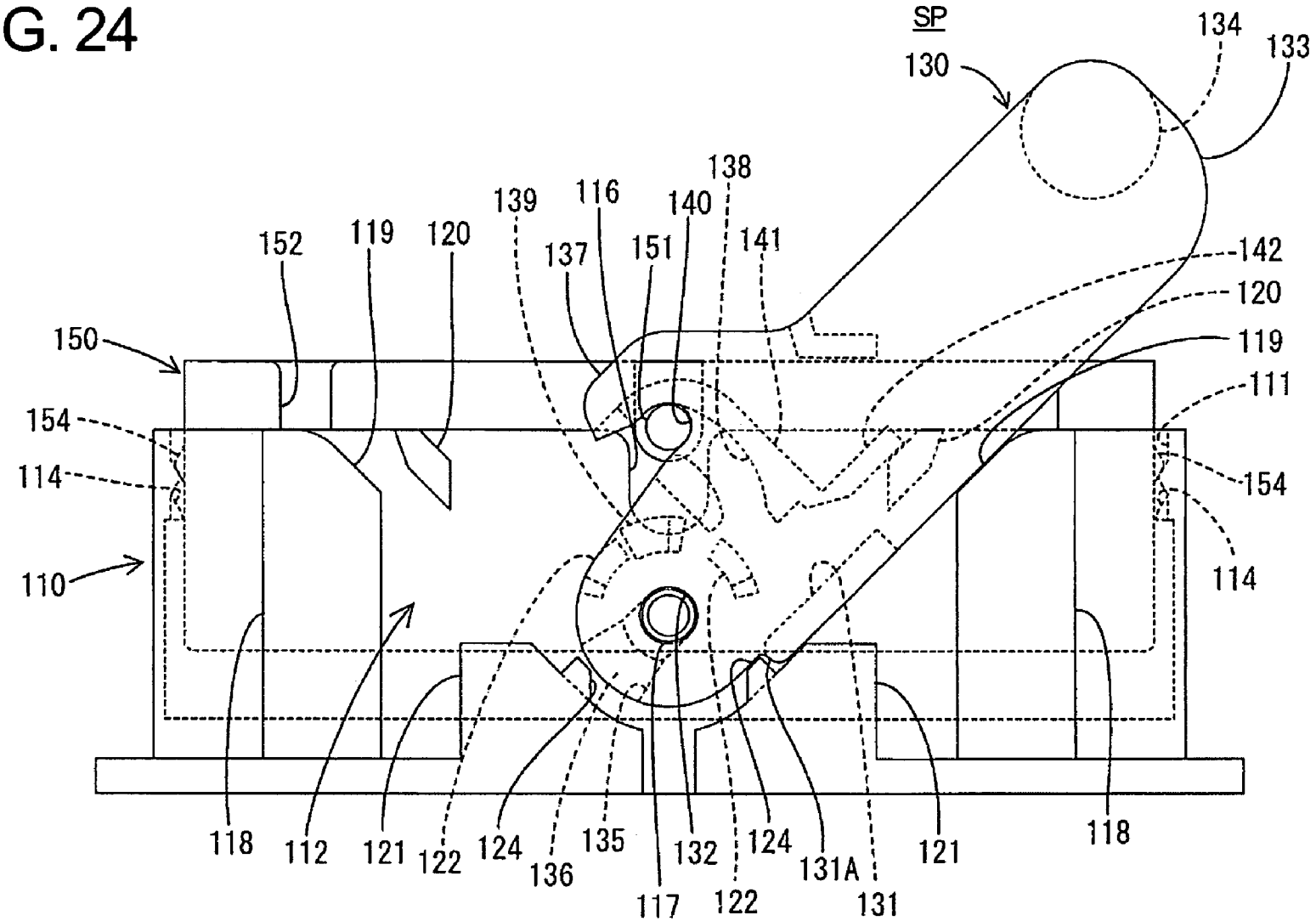
FIG. 24 is a side view showing a state where the lever is assembled at a standby position in a reversed posture with respect to that in FIG. 19.
Figure 31:
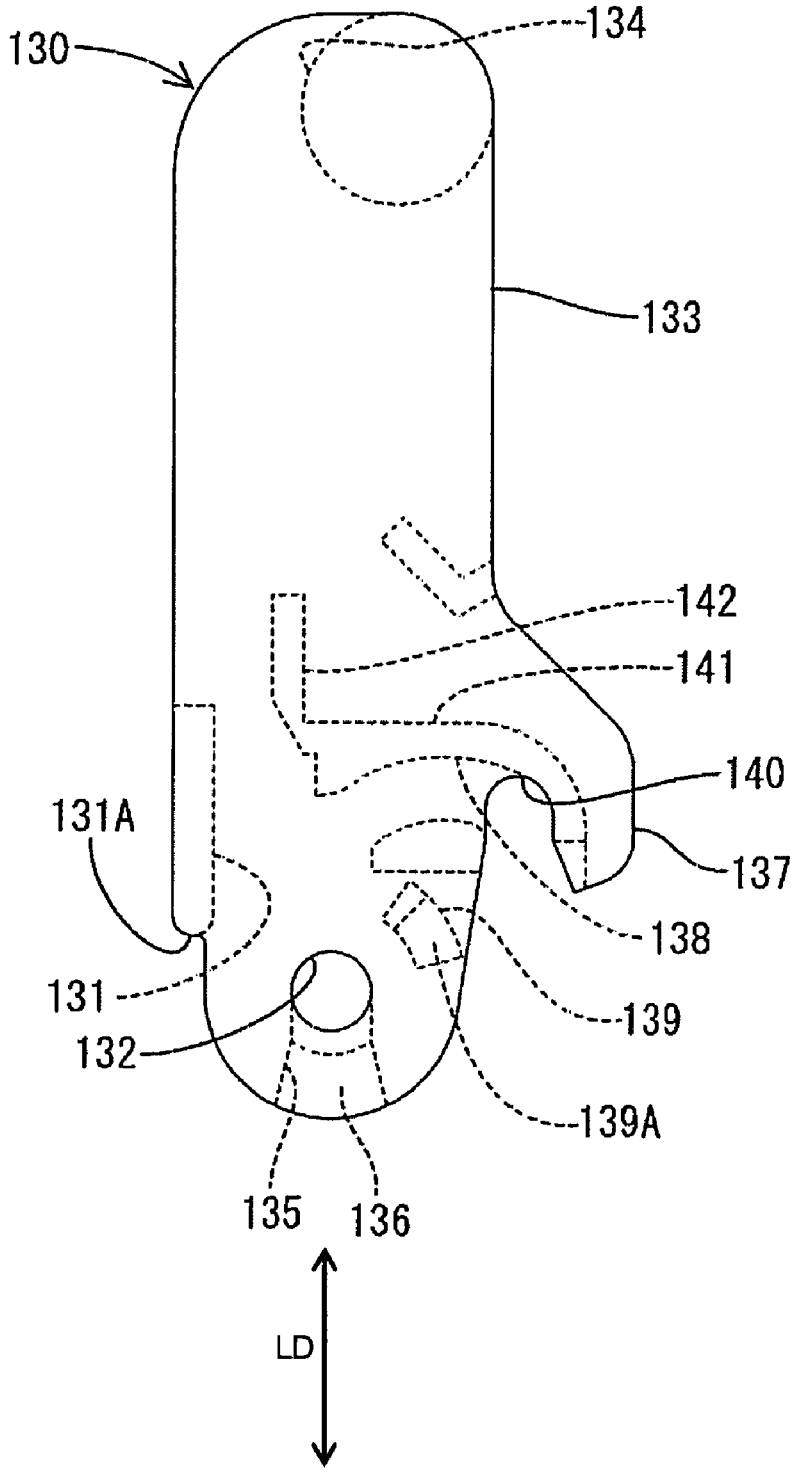
FIG. 31 is a side view of the lever.
Figure 32:
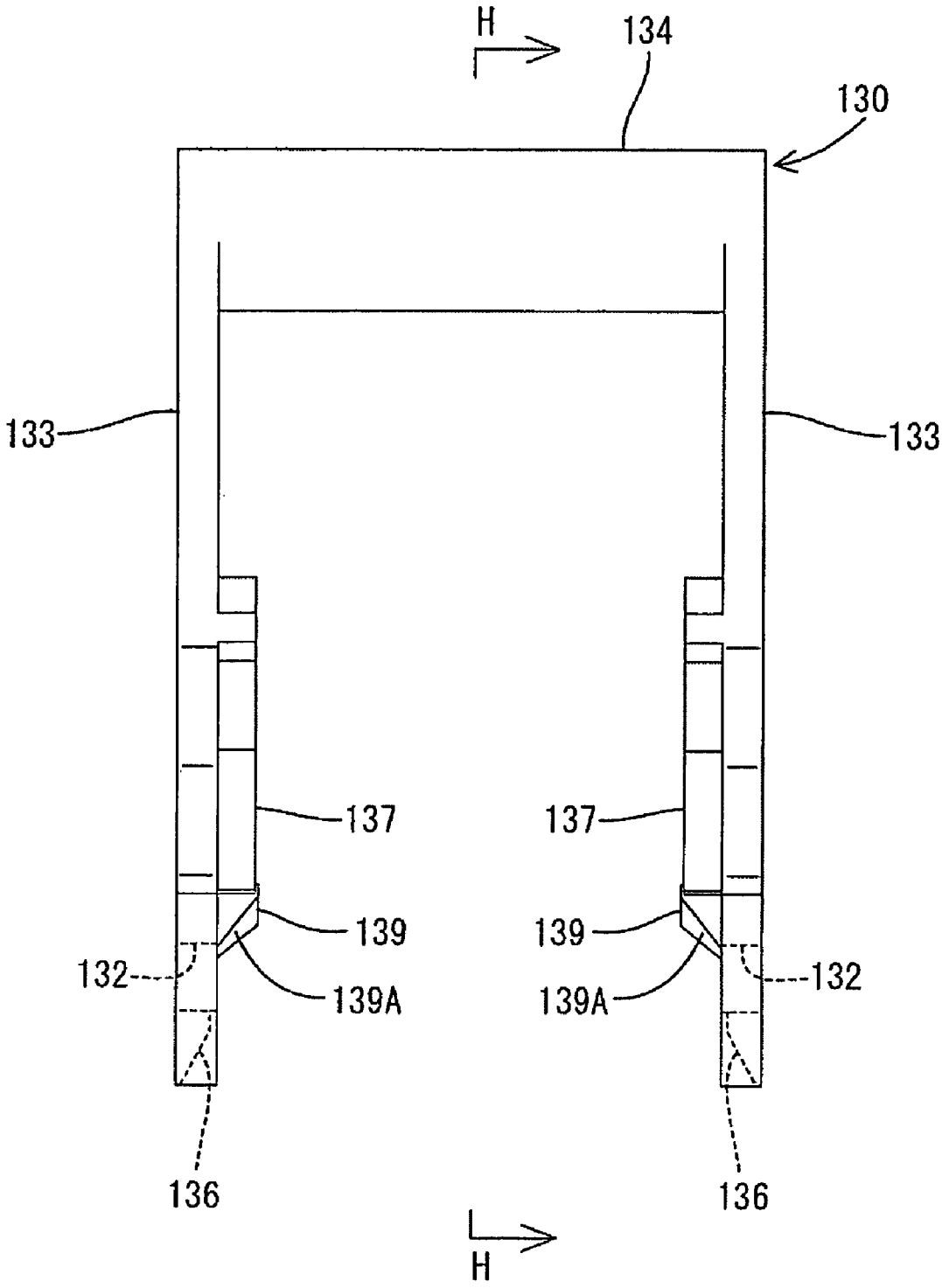
FIG. 32 is a front view of the lever.
Figure 33B:
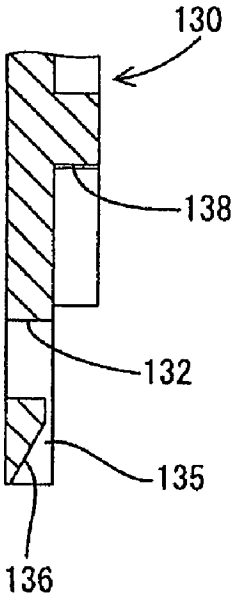
FIG. 33(B) is a partial enlarged section along 33B-33B of FIG. 33(A).
Figure 33A:
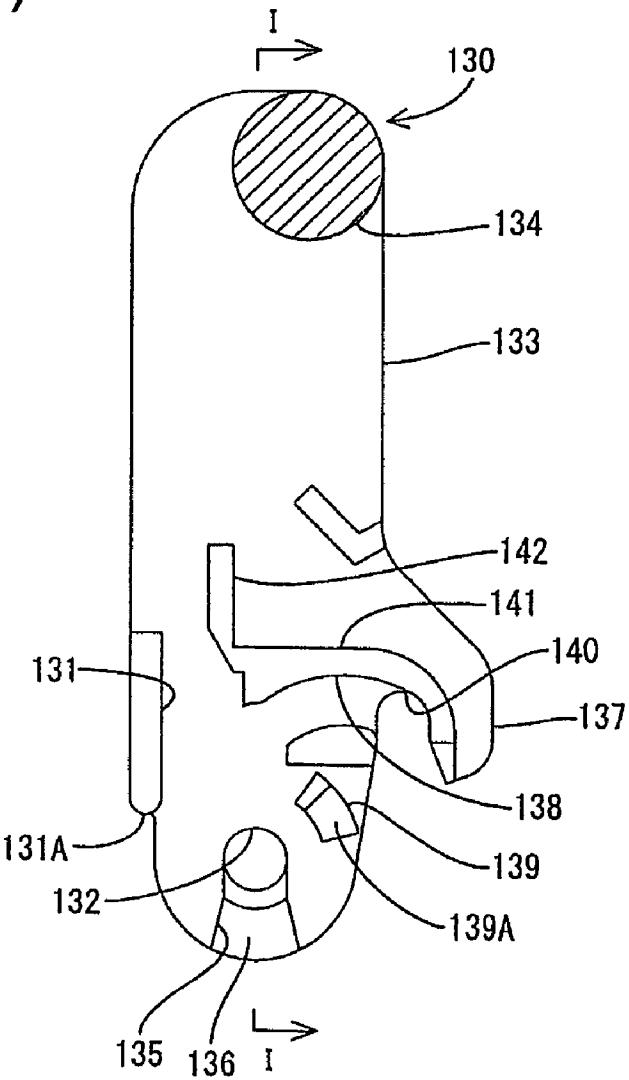
FIG. 33(A) is a section along 33A-33A of FIG. 32

The connector also has a lever 130 made e.g. of a synthetic resin. The lever 130 is substantially gate-shaped and has two arms 133 at opposite ends of an operable portion 134, as shown in FIGS. 31 and 32. The arms 133 are substantially opposed to each other, and can be deformed resiliently along opposing directions. Additionally, the arms 133 are substantially transversely symmetrical with respect to the operable portion 134. As shown in FIG. 17 or 18, the lever 130 can be assembled with the first housing 110 from an oblique left-front side with the free ends of the arms 133 faced forward. Conversely, the lever 130 also can be assembled from an oblique right-front side, as shown in FIG. 23 or 24. FIG. 19 shows the lever 130 assembled at a standby position SP from the oblique left-front side of the first housing 110. The lever 130 then is rotatable clockwise preferably by more than about 200, and more preferably by about 45°, about the supporting shafts 117 from the standby position SP to a connection position CP shown in FIG. 20. The lever 130 is rotatable further clockwise preferably by more than about 20°, more preferably by about 45°, about the supporting shafts 117 from the connection position CP to a detachment position DP shown in FIG. 21. The terms vertical direction VD and transverse direction TD are used herein to describe the orientation of the lever 130 at the connection position CP on the first housing 110.

As shown in FIG. 31, a bearing hole 132 penetrates the bottom end of the arm 133. A guiding groove 135 is formed in the inner surface of the arm 133 and extends from the bottom edge to the bearing hole 132. A push-up surface 136 is formed in the guiding groove 135 and slopes gradually up from the bottom edge of the arm 133 to the bearing hole 132. Upon assembling the lever 130 with the first housing 110, the supporting shafts 117 enter the guiding grooves 135 and move onto the push-up surfaces 136, as shown in FIG. 18. Thus, the arms 133 deform resiliently out and away from each other. The two arms 133 restore resiliently when the supporting shafts 117 move beyond the push-up surfaces 136. Thus, the bearing holes 132 fit onto the supporting shafts 117, and the lever 130 is supported rotatably, as shown in FIG. 19.

An arcuate cam groove 138 is formed in the inner surface of each arm 133 and is substantially centered on the bearing hole 132. More particularly, the cam groove 138 gradually approaches the bearing hole 132 when seen in a radial direction. Further, a hook 137 is formed at the right edge of each arm 133. The hook 137 extends obliquely back and to the right and then bulges down and out. The entrance 140 to the cam groove 138 is on a portion of the arm 133 at the base of the hook 137.

An upper wall 141 is formed along a side of the cam groove 138 and extends from the vicinity of the entrance 140 of the cam groove 138. The end of the upper wall 141 then bends up to form a guide edge 142. As shown in FIGS. 18 and 19, the guide edge 142 slides in contact with the upper surface of the guiding portion 120 upon assembling the lever 130 with the first housing 110 to guide the assembly of the lever 130.

A detachment interacting portion 139 is formed obliquely forward from each bearing hole 132 and interacts with the detaching portion 122. The detachment interacting portion 139 extends in a circumferential direction substantially centered on the bearing hole 132 and has a sliding-contact portion 139A that slopes gradually up along the counterclockwise direction. At the connection position, the sliding contact surfaces 139A contact the sliding contact surfaces 122A of the detaching portions 122 to prevent the lever 130 from rotating clockwise.

A guidable portion 131 projects in at the edge of each arm 133, and a step 131A is retracted slightly towards the bearing hole 132 at the bottom end of the guidable portion 131. The steps 131A contact the auxiliary stoppers 124 when the lever 130 is assembled (see FIG. 19) to limit movement of the lever 130 in the assembling direction.

Figure 27:
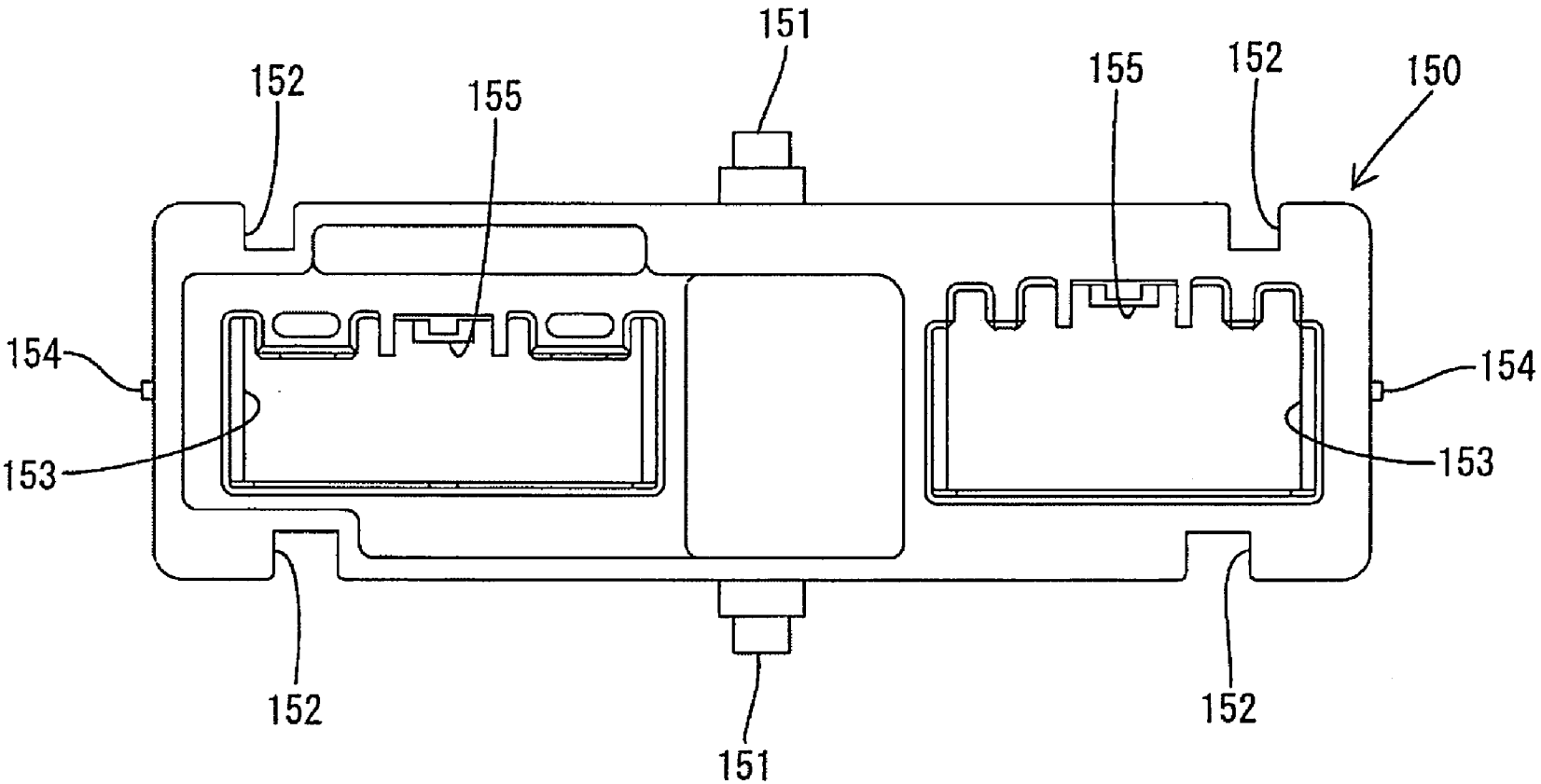
FIG. 27 is a plan view of the second housing.
Figure 28:
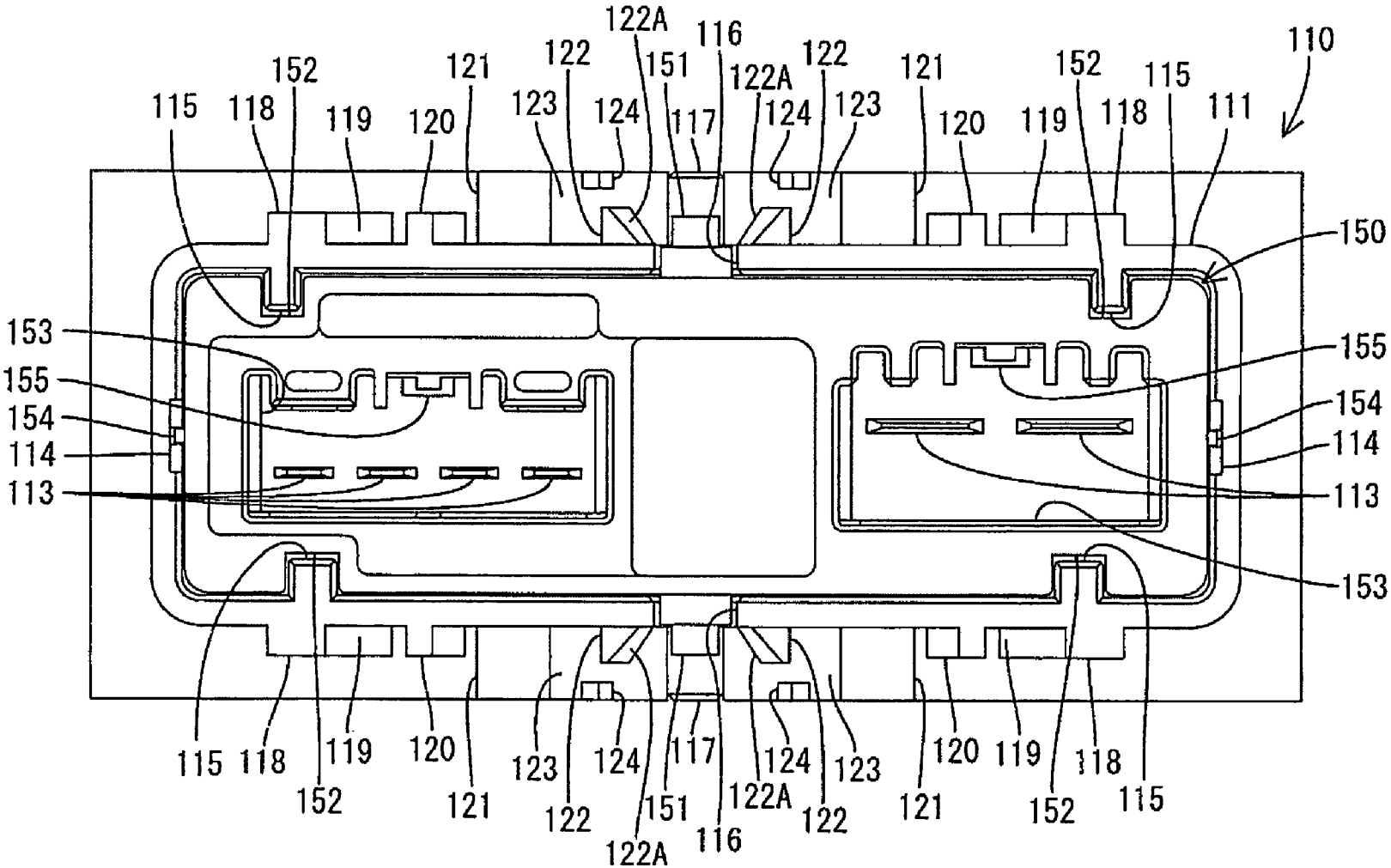
FIG. 28 is a plan view showing a properly connected state of the two housings with the lever detached.

The second housing 150 is made e.g. of a synthetic resin, and defines a substantially rectangular block with two connector chambers 153, as shown in FIGS. 27 and 29. Unillustrated auxiliary connectors are insertable into the connector chambers 153 from behind and are retained by retaining pieces 155 in the connector chambers 153. Unillustrated cavities penetrate each auxiliary connector in forward and backward directions FBD, and unillustrated female terminal fittings are inserted into the respective cavities from behind. The female terminal fittings connect electrically with the tabs 113 of the male terminal fittings upon connecting the two housings 110, 150.

Substantially cylindrical cam followers project out on the outer peripheral surface of the second housing 150 and have center axes that extend substantially along the width direction WD. The cam followers 151 can enter the escaping grooves 116 of the first housing 110 during the connecting operation of the two housings 110, 150. The cam followers 151 are located substantially on the axis of symmetry 101 with the two housings 110, 150 initially fit together (see FIG. 17), and are at the entrances 140 of the cam grooves 138 when the lever 130 is assembled. A latch 154 is provided on the outer surface of each shorter side of the second housing 150, and an engaging portion 114 is provided on the inner surface of each shorter side of the receptacle 111 of the first housing 110. The latches 154 contact the front sides of the corresponding engaging portions 114 at an initial stage of the connecting operation of the two housings 110, 150 to hold the housings 110, 150 in an initially fitted state. The latches 154 move over the engaging portions 114 and engage the back sides of the engaging portions 114 when the two housings 110, 150 are connected properly to prevent the two housings 110,150 from separating.

The second housing 150 is fit partly into the receptacle 111 of the first housing 110 prior to assembling the lever 130 with the first housing 110. In this state, the latches 154 contact the front sides of the corresponding engaging portions 114 with respect to connecting direction CD as shown in FIG. 17. Additionally, the rear end of the second housing 150 projects by a specified length from the opening edge of the receptacle 111.

The lever 130 then is assembled at the standby position SP. More particularly, the lever 130 is moved obliquely towards the supporting shafts 117 from the front of the first housing 110. Thus, the guidable portions 131 of the lever 130 pass between the guides 120 and the guiding surfaces 119 and the guiding edges 142 slide in contact with the guides 120 to guide the assembly of the lever 130. The push-up surfaces 136 of the lever 130 then contact the supporting shafts 117, as shown in FIG. 18, and the arms 133 deform resiliently out. The arms 133 restore resiliently when the push-up surfaces 136 move over the supporting shafts 117, and the supporting shafts 117 fit into the bearing holes 132 to assemble the lever 130 rotatably, as shown in FIG. 19. At this moment, the steps 131A of the guidable portions 131 contact the auxiliary stoppers 124 to prevent further movement of the lever 130 in the assembling direction. Further, the guide edges 142 contact the guides 120 to prevent counterclockwise rotation of the lever 130. The cam followers 151 are at the entrances 140 of the cam grooves 138 when the lever 130 is assembled at the standby position SP.

Figure 20:
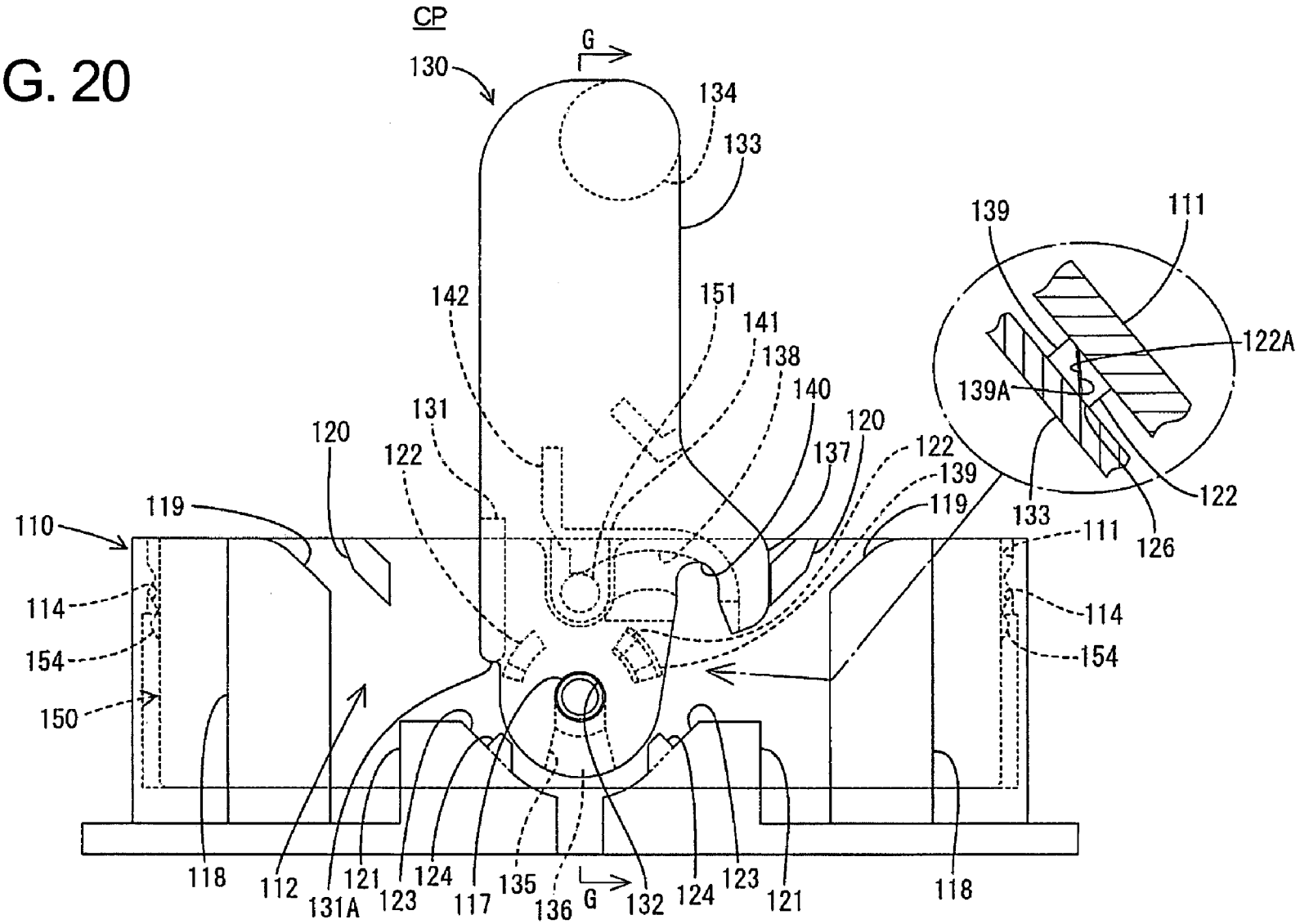
FIG. 20 is a side view showing a properly connected state of the second housing with the lever held at a connection position.

The operable portion 134 then is engaged by fingers to rotate the lever 130 clockwise around the supporting shafts 117 (preferably about 45°) to the connection position CP shown in FIG. 20. The first housing 110 is pulled strongly towards the second housing 150 in the process of rotating the lever 130 towards the connection position CP due to a force multiplying action caused by the engagement of the cam grooves 138 and the cam followers 151. Thus, the two housings 110, 150 advance into a properly connected state. During this time, the latches 154 move over the engaging portions 114 and engage the back sides of the engaging portions 114 with respect to the connecting direction CD to lock the housings 110, 150 in the properly connected state.

Figure 21:
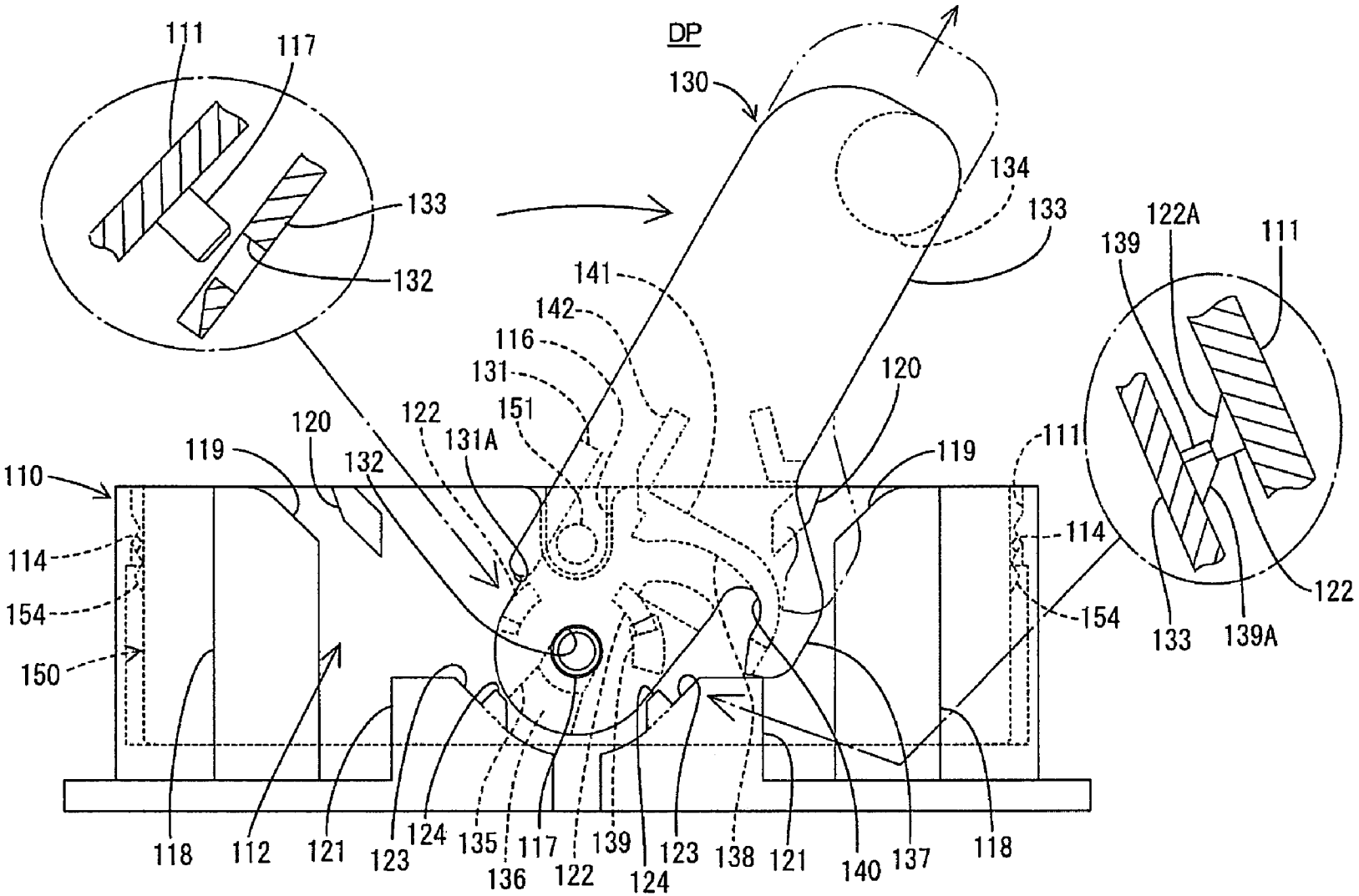
FIG. 21 is a side view showing the properly connected state of the second housing with the lever held at a detachment position.
Figure 22:
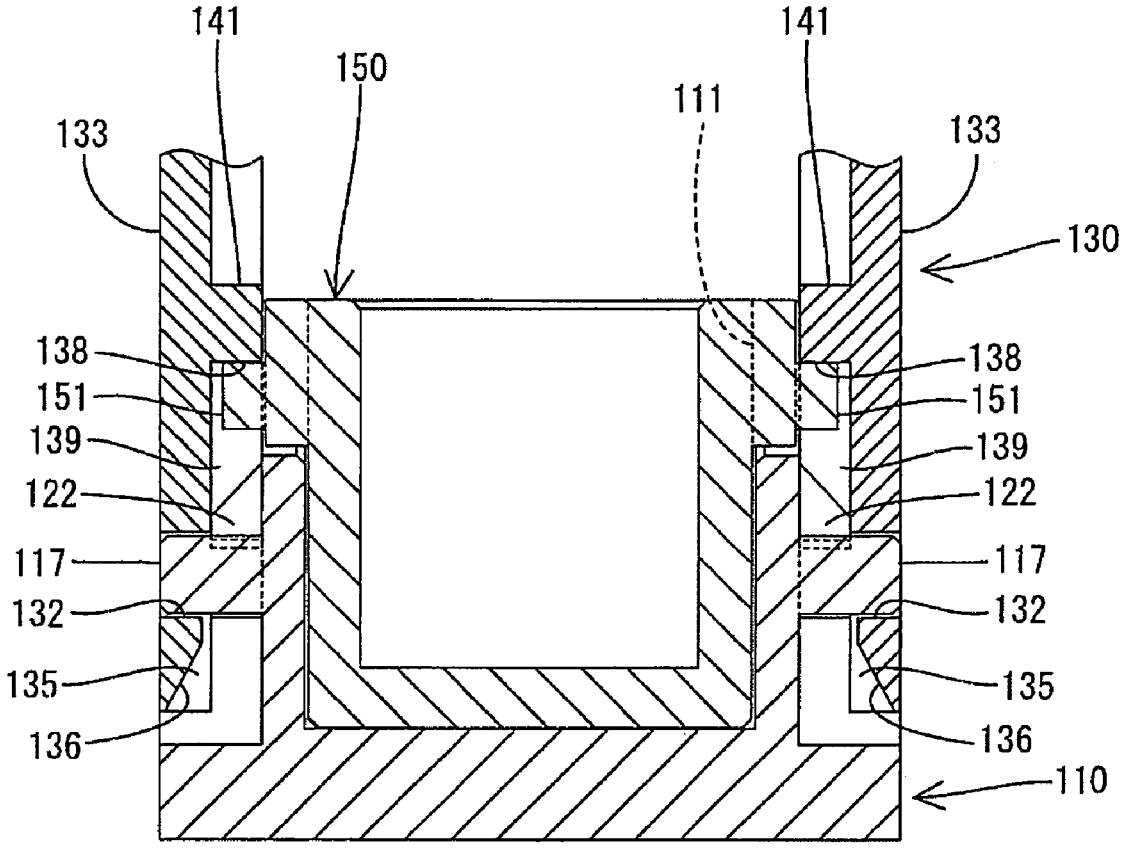
FIG. 22 is a partial enlarged section along 22-22 of FIG. 20.

The lever 130 can be rotated further clockwise around the supporting shafts 117 (preferably by about 450 or more) to the detachment position shown in FIG. 21. During this time, the sliding contact surfaces 139A of the detachment interacting portions 139 deform resiliently out away from the first housing 110 to disengage the supporting shafts 117 from the bearing holes 132. The lever 130 then can be moved obliquely forward to the right for detachment from the first housing 110.

Figure 25:
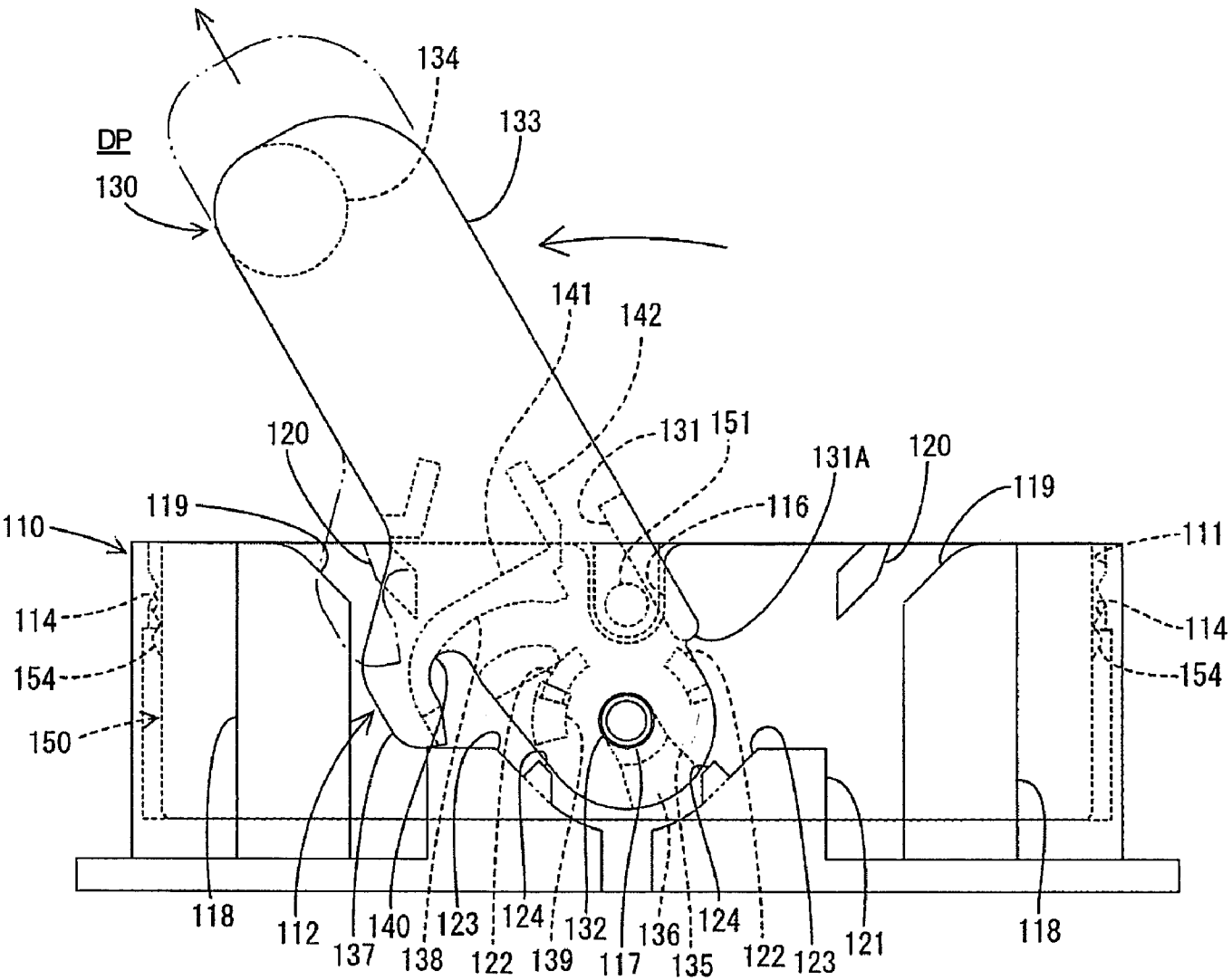
FIG. 25 is a side view showing a state where the lever is assembled at a detachment position in a reversed posture with respect to that in FIG. 21.
Figure 26:
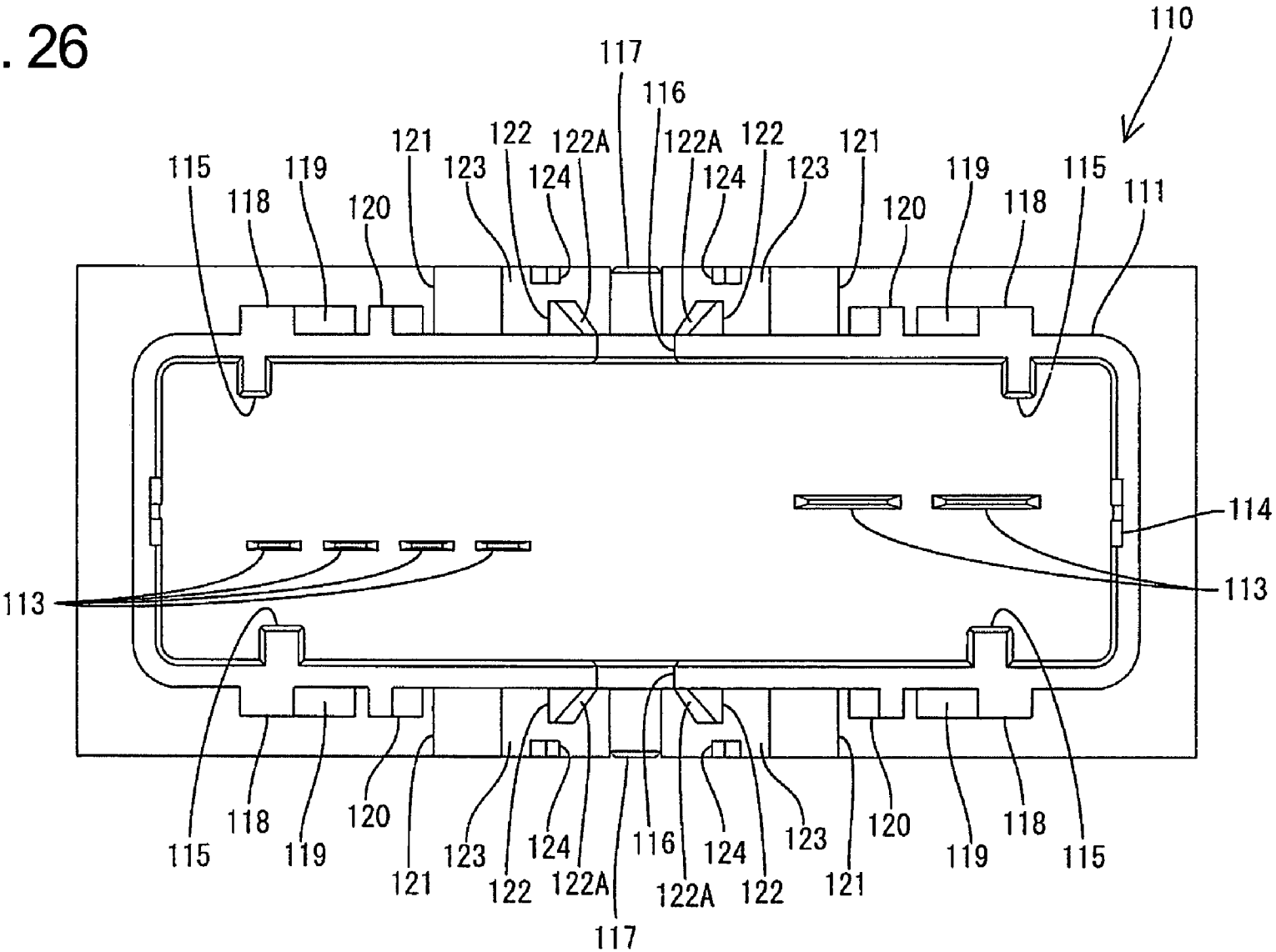
FIG. 26 is a plan view of a first housing.

FIGS. 23 to 25 show states where the lever 130 is assembled in a reversed posture so that the lever 130 is rotated counterclockwise from the standby position SP to the connection position CP and from the connection position CP to the detachment position DP. FIG. 24 shows the lever 130 at the standby position SP, and FIG. 25 shows the lever 130 at the detachment position DP. Both states shown in FIGS. 24 and 25 are transversely substantially symmetrical to those shown in FIGS. 19 and 21. The functions for assembling the lever 130 at the standby position SP, for connecting the two housings 110, 150, and for detaching the lever 130 from the detachment position DP are also transversely substantially symmetrical to the above corresponding functions. Accordingly, these functions are not described here.

As described above, the lever 130 can be assembled with the first housing 110 in either one of the two postures substantially symmetrical with respect to the axis of symmetry 101. The rotating direction of the lever 130 is changed by transversely reversing the assembling posture of the lever 130. Thus, the rotation operability of the lever 130 can be improved by selecting the assembling posture of the lever 130 depending on circumstances in which the connector is arranged. Further, since the lever 130 is detached from the first housing 110 by being displaced in the direction away from the first housing 110 upon reaching the detachment position from the connection position CP, the connector can be miniaturized as a whole, and it is convenient because labor and time for detaching the lever 130 can be saved. As a result, it is not necessary to provide the lever 130 for each connector by using the lever 130 as a jig for connectors and, therefore, the number of parts can be reduced.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The locking state of the resilient lock for preventing the displacement of the lever from the standby position SP to the connection position CP is canceled as the second housing is fitted in the foregoing embodiment. However, the locking state of the resilient lock may be canceled independently of the initial fitting operation of the second housing.

The lever main body is rotated in the accommodation space in the foregoing embodiment. However, the lever main body may be rotated while being exposed at the outer surface of the first housing.

The return preventing locking means of the lever is resiliently deformable resilient lock and that of the first housing is not resiliently deformable in the first embodiment. However, the return preventing locking means of the first housing may be resiliently deformable and that of the lever may not be resiliently deformable or both may be resiliently deformable.

The front-stop holding means of the lever is the resiliently deformable resilient lock and that of the first housing is not resiliently deformable in the first embodiment However, the front-stop holding means of the first housing may be resiliently deformable and that of the lever may not be resiliently deformable or both may be resiliently deformable.

The reverse-rotation preventing portion of the first housing is arranged substantially on the axis of symmetry in the first embodiment. However, the reverse-rotation preventing portions may be at two positions substantially symmetrical with respect to the axis of symmetry.

The front-stops of the first housing are at the two positions substantially symmetrical with respect to the axis of symmetry in the first embodiment. However, a front-stop of the first housing may be arranged substantially on the axis of symmetry.

The front-stop portions of the first housing are at the two positions substantially symmetrical with respect to the axis of symmetry in the first embodiment. However, a front-stop of the first housing may be arranged substantially on the axis of symmetry.

The return preventing portions of the first housing are arranged at the two positions substantially symmetrical with respect to the axis of symmetry in the first embodiment. However, a return preventing portion of the first housing may be substantially on the axis of symmetry.

The finger placing portion and the protecting portion of the resilient lock are displaced in the area outside the accommodation space in the first embodiment. However, they may be displaced in the accommodation space.

The resiliently displacing directions of the resilient lock are substantially the same directions as the thickness direction of the lever in the first embodiment. However, they may be directions at angles to the thickness direction the lever.

The resilient lock is a plate substantially parallel with or flush with the lever main body in the first embodiment. However, the plate surface of the resilient lock may be at an angle to the plate surface of the lever main body.

The protecting portion surrounds the resilient lock at upper, lower, left and right sides in the first embodiment. However, it may hold the resilient lock between the substantially opposite left and right sides.

The detaching portions are arranged substantially transversely symmetrical with respect to the axis of symmetry in the second embodiment. However, they may be substantially on the axis of symmetry.

The invention has been described with reference to levers rotatably provided in or on a housing. However, the invention also is applicable to levers or other movable members that move between a standby position and a connecting position along a path different from an arc shaped path, such as a substantially linear path, substantially elliptic path or the like.

What is claimed is:

1. A lever-type connector, comprising:

a first housing connectable with a second housing, a plate-shaped lever with opposite first and second surfaces, the lever being displaceably assembled with a mounting surface of the first housing in a first posture where the first surface of the lever faces the mounting surface or a second posture where the second surface of the lever faces the mounting surface, the lever being formed with at least one cam configured to display a cam action in cooperation with a mating cam, the lever being displaceable from a first standby position to a first connection position when the lever is in the first posture to assist connection of the first housing with the second housing by the cam action caused by engagement of the cam and the mating cam, the lever further being displaceable from a second standby position to a second connection position when the lever is in the second posture to assist connection of the first housing with the second housing by the cam action caused by engagement of the cam and the mating cam, holding means on at least one of the first housing and the lever for holding the lever at the first standby position when the lever is in the first posture, and for holding the lever at the second standby position when the lever is in the second posture, a first locking means on at least one of the first housing and the lever for locking the lever at the first connection position when the lever is in the first posture, and a second locking means on at least one of the first housing and the lever for locking the lever at the second connection position when the lever is in the second posture.

2. The lever-type connector of claim 1, wherein the cam means comprises a cam groove and wherein the entrance of the cam groove is on an axis of symmetry substantially parallel with a connecting direction of the first housing with the second housing when the lever is at either of the first and second standby positions.

3. The lever-type connector of claim 1, wherein the first housing has an axis of symmetry substantially parallel with a connecting direction of the first housing with the second housing, and wherein the lever is displaced by rotation around a rotational axis through which the axis of symmetry passes.

4. The lever-type connector of claim 1, wherein the lever has an operable portion for displacing the lever, the operable portion including a resilient lock displaceable between a locking position where the resilient lock engages one of the first and second locking means of the first housing and an unlocking position where the resilient lock disengages the first and second locking means.

5. The lever-type connector of claim 4, where resilient displacing directions of the resilient lock are substantially the same as a thickness direction of the plate-shaped lever.

6. The lever-type connector of claim 1, wherein the first housing includes an accommodation space for accommodating the lever, the mounting surface being in the accommodation space.

7. The lever-type connector of claim 6, wherein the lever has an operable portion for displacing the lever, the operable portion including a resilient lock displaceable between a locking position where the resilient lock engages one of the first and second locking means of the first housing and an unlocking position where the resilient lock disengages from the first and second locking means, and a protecting portion at least partly surrounding the resilient lock.

8. The lever-type connector of claim 7, wherein an area of the operable portion including the protecting portion is displaced outside the accommodation space in the process of displacing the lever.

9. The lever-type connector of claim 1, wherein the housing has an axis of symmetry substantially parallel with a connecting direction of the first housing with the second housing, and wherein the cam is a cam groove and has an entrance substantially on the axis of symmetry when the lever is at either of the first and second standby positions.

10. The lever-type connector of claim 9, wherein the lever is displaced between either of the first and second standby positions and the respective first or second connecting position by rotating the lever around a rotational axis through which the axis of symmetry passes.

11. The lever-type connector of claim 9, wherein the lever is displaceable to a detachment position beyond either of the connection positions.

12. The lever-type connector of claim 11, wherein detaching means are provided between the first housing and the lever for displacing the lever in a direction away from the first housing to disengage a supported portion when the lever substantially reaches the detachment position.

13. The lever-type connector assembly comprising the lever-type connector of claim 1 and a mating connector comprising the second housing.

14. The lever-type connector of claim 1, wherein the first housing has an axis of symmetry substantially parallel with a connecting direction of the first housing with the second housing, the holding means of the first housing is substantially on the axis of symmetry or at two positions substantially symmetrical to the axis of symmetry.

15. The lever-type connector of claim 1, wherein the first housing has an axis of symmetry substantially parallel with a connecting direction of the first housing with the second housing, the locking means of the first housing is substantially on the axis of symmetry or at two positions substantially symmetrical to the axis of symmetry.

16. The lever-type connector of claim 1, wherein the lever is movable in a first direction from the first standby position to the first connection position when lever is in the first posture, and wherein the lever is movable in a second direction substantially opposite the first direction from the second standby position to the second connection position when the lever is in the second posture.

17. The lever-type connector of claim 1, wherein the first housing has an axis symmetry substantially parallel with a connecting direction of the first housing with the second housing, the lever having an operable portion for displacing the lever, the operable portion being to one side of the axis of symmetry when the lever is in the first posture and at the first standby position, the operable portion being on a second side of the axis of symmetry when the lever is in the second posture and at the second standby position.

18. The lever-type connector of claim 1, wherein the first locking means is formed on the first housing and is engageable with the lever for locking the lever at the first connection position when the lever is in the first posture, and wherein the second locking means is on the first housing and is engageable with the lever for locking the lever at the second connection position when the lever is in the second posture.

* * * * *